US007907105B2

(12) United States Patent
Shirasaki et al.

(10) Patent No.: US 7,907,105 B2
(45) Date of Patent: Mar. 15, 2011

(54) DISPLAY APPARATUS AND METHOD FOR DRIVING THE SAME, AND DISPLAY DRIVER AND METHOD FOR DRIVING THE SAME

(75) Inventors: Tomoyuki Shirasaki, Higashiyamato (JP); Jun Ogura, Fusse (JP)

(73) Assignee: Casio Computer Co., Ltd., Tokyo (JP)

( * ) Notice: Subject to any disclaimer, the term of this patent is extended or adjusted under 35 U.S.C. 154(b) by 850 days.

(21) Appl. No.: 11/891,157

(22) Filed: Aug. 9, 2007

(65) Prior Publication Data

US 2008/0036708 A1 Feb. 14, 2008

(30) Foreign Application Priority Data

Aug. 10, 2006 (JP) ..... 2006-218760

(51) Int. Cl.
*G09G 3/30* (2006.01)

(52) U.S. Cl. ..... 345/77; 345/83

(58) Field of Classification Search ..... 345/76–84, 345/211

See application file for complete search history.

(56) References Cited

U.S. PATENT DOCUMENTS

| | | | | |
|---|---|---|---|---|
| 6,518,962 | B2 | 2/2003 | Kimura et al. | |
| 6,960,889 | B2 * | 11/2005 | Park et al. | 315/169.2 |
| 7,012,586 | B2 | 3/2006 | Kageyama et al. | |
| 7,719,492 | B2 | 5/2010 | Childs | |
| 2002/0101172 | A1 | 8/2002 | Bu | |
| 2002/0105279 | A1 | 8/2002 | Kimura | |
| 2003/0063081 | A1 | 4/2003 | Kimura et al. | |
| 2004/0017161 | A1 | 1/2004 | Choi | |
| 2004/0239596 | A1 * | 12/2004 | Ono et al. | 345/76 |
| 2005/0052350 | A1 * | 3/2005 | Mizukoshi et al. | 345/55 |
| 2006/0082528 | A1 * | 4/2006 | Guo et al. | 345/82 |
| 2006/0145965 | A1 * | 7/2006 | Choi et al. | 345/76 |
| 2007/0024544 | A1 * | 2/2007 | Chung et al. | 345/76 |
| 2008/0180365 | A1 | 7/2008 | Ozaki | |

FOREIGN PATENT DOCUMENTS

| | | | |
|---|---|---|---|
| JP | 8-330600 | A | 12/1996 |
| JP | 2005-115144 | A | 4/2005 |
| JP | 2005-134435 | A | 5/2005 |
| KR | 2000-10923 | A | 2/2000 |
| WO | 2005/069267 | A1 | 7/2005 |

(Continued)

OTHER PUBLICATIONS

Korean Office Action dated Nov. 17, 2009 (5 pages), and English translation thereof (6 pages), issued in counterpart Korean Application Serial No. 10-2008-7021878.

(Continued)

*Primary Examiner* — Chanh Nguyen
*Assistant Examiner* — Allison Walthall
(74) *Attorney, Agent, or Firm* — Holtz, Holtz, Goodman & Chick, PC

(57) ABSTRACT

A display apparatus includes: a light-emitting device; a pixel circuit which is connected to the light-emitting device; a display driver having a voltage adjustment section which adjusts the potential of an adjustment voltage such that the potential thereof is approximated to a potential which is changed in accordance with the change amount of the characteristics inherent to the pixel circuit when a reference current having a predetermined current value is supplied to the pixel circuit; and a data line which connects the display driver and pixel circuit.

16 Claims, 17 Drawing Sheets

FOREIGN PATENT DOCUMENTS

WO 2007/037269 A1 4/2007

OTHER PUBLICATIONS

Tomoyuki Maeda et al: "60.5L Late-News Paper: An Improved Current Driving Method For 256-Level Full Color Active Matrix OLED Displays", 2002 SID Symposium, Seattle, WA., May 25-27, 2004, SID, US, May 25, 2004, pp. 1572-1575, XP007012020—entire document.

Japanese Office Action dated Nov. 25, 2010 (and English translation thereof) in counterpart Japanese Application No. 2006-218760.

* cited by examiner

DISPLAY APPARATUS AND METHOD FOR DRIVING THE SAME, AND DISPLAY DRIVER AND METHOD FOR DRIVING THE SAME

BACKGROUND OF THE INVENTION

1. Field of the Invention

The present invention relates to a display apparatus and method for driving the same, and a display driver and method for driving the same. More particularly, the invention relates to a display apparatus and display driver having a display panel (display pixel array) in which a plurality of current-drive type (or current-control type) light-emitting devices which receive a current corresponding to display data to emit light at a predetermined luminance gradation are arranged, and a method for driving the display apparatus and display driver.

2. Description of the Related Art

There is known, as a next generation display apparatus to be the successor to a liquid crystal display apparatus, a current-drive type light-emitting device such as an organic electro luminescence device (organic EL device), inorganic electro luminescence device (inorganic EL device), and light-emitting diode (LED). In recent years, research and development of light-emitting type display apparatuses provided with a display panel in which the current-drive type light-emitting devices are arranged in a matrix manner have been greatly promoted.

Particularly, the light-emitting type display apparatus using an active matrix type drive system has higher display response speed than a known liquid crystal display apparatus and no dependence on an angle of field, and is capable of providing high luminance and contrast, high definition of quality of display image, and the like. The light-emitting type display apparatus has an extremely advantageous characteristic in which no backlight or no light guide plate is required unlike the liquid crystal display apparatus to allow the apparatus to be much thinner and lighter. Therefore, such a light-emitting type display apparatus is expected to be applied to various electronics apparatus.

For example, an organic EL display apparatus disclosed in Unexamined Japanese Patent Application KOKAI Publication No. H8-330600 is an active matrix type display apparatus which is current-controlled by a voltage signal, in which a thin-film transistor for current control and a thin-film transistor for switching operation are provided for each pixel. The thin-film transistor for current control supplies a current to the organic EL device in response to an application of a voltage signal corresponding to image data to a gate terminal. The thin-film transistor for switching operation performs switching operation for supplying the voltage signal corresponding to image data to the gate terminal of the thin-film transistor for current control.

SUMMARY OF THE INVENTION

The organic EL display apparatus that uses such a voltage signal to control gradation has a problem that the value of a current flowing through the organic EL device is varied due to a temporal variation in a threshold value of the thin-film transistor for current control and the like.

An object of the present invention is to provide a display driver and method for driving the same capable of allowing a light-emitting device to emit light at an appropriate luminance gradation corresponding to display data to thereby provide a display apparatus and method for driving the same capable of displaying a high quality and uniform display image.

A display apparatus according to the present invention includes: a light-emitting device; a pixel drive circuit which is connected to the light-emitting device; a display driver having a voltage adjustment section which adjusts the potential of an adjustment voltage such that the potential thereof is approximated to a potential which is changed in accordance with the change amount of the characteristics inherent to the pixel drive circuit when a reference current having a predetermined current value is supplied to the pixel drive circuit; and a data line which connects the display driver and pixel drive circuit.

In the display apparatus according to present invention, the voltage adjustment section generates the adjustment voltage on the basis of a gradation voltage having a predetermined potential correspond to a display data and an offset voltage set according to the potential which is changed in accordance with the change amount of the characteristics inherent to the pixel drive circuit.

In the display apparatus according to present invention, the display driver has a voltage comparison section which compares the potential in the voltage adjustment section and the potential which is changed in accordance with the change amount of the characteristics inherent to the pixel drive circuit when the reference current having a predetermined current value is supplied to the pixel drive circuit.

In the display apparatus according to present invention, the voltage comparison section has a current source which supplies the reference current having a predetermined current value to the pixel drive circuit.

In the display apparatus according to present invention, the voltage comparison section has a connection path switch which switchingly connects the current source or the voltage adjustment section to the data line.

In the display apparatus according to present invention, the potential which is changed in accordance with the change amount of the characteristics inherent to the pixel drive circuit when the reference current having a predetermined current value is supplied to the pixel drive circuit is output to the voltage comparison section when the connection path switch connects the current source to the data line.

In the display apparatus according to present invention, the display driver has an offset voltage generation section which generates an offset voltage on the basis of a result of comparison, which is made by the voltage comparison section, between the potential in the voltage adjustment section and the potential which is changed in accordance with the change amount of the characteristics inherent to the pixel drive circuit when the reference current having a predetermined current value is supplied to the pixel drive circuit.

In the display apparatus according to present invention, when the voltage comparison section determines that the potential in the voltage adjustment section is higher than the potential which is changed in accordance with the change amount of the characteristics inherent to the pixel drive circuit when the reference current having a predetermined current value is supplied to the pixel drive circuit, the offset voltage generation section modulates the offset voltage.

In the display apparatus according to present invention, the offset voltage generation section counts the number of inputs of a signal output from the voltage comparison section when the potential in the voltage adjustment section is higher than the potential which is changed in accordance with the change amount of the characteristics inherent to the pixel drive circuit when the reference current having a predetermined current value is supplied to the pixel drive circuit.

In the display apparatus according to present invention, the offset voltage generation section modulates the offset voltage according to an offset setting value which is changed depending on the number of inputs of the signal output from the voltage comparison section.

In the display apparatus according to present invention, the offset voltage has a value obtained by multiplying the offset setting value by a unit voltage.

In the display apparatus according to present invention, the offset voltage generation section outputs the offset setting value which is changed depending on the number of inputs of the signal output from the voltage comparison section according to the signal which is output from the voltage comparison section when the potential in the voltage adjustment section is equal to or lower than the potential which is changed in accordance with the change amount of the characteristics inherent to the pixel drive circuit when the reference current having a predetermined current value is supplied to the pixel drive circuit.

In the display apparatus according to present invention, the display driver has a storage section which stores the offset setting value output from the offset voltage generation section.

The display apparatus according to present invention includes a plurality of display pixels each constituted by a set of the light-emitting device and pixel drive circuit, and the storage section stores the offset setting value in units of each display pixel.

In the display apparatus according to present invention, the display driver has a storage section which stores the offset setting value output from the offset voltage generation section, and the offset voltage generation section outputs an offset voltage obtained by multiplying the offset setting value output from the storage section by a unit voltage to the voltage adjustment section.

In the display apparatus according to present invention, the pixel drive circuit includes a driving transistor connected in series to the light-emitting device.

In the display apparatus according to present invention, the pixel drive circuit includes a selection transistor connected between the driving transistor and data line and a transistor for diode connection which sets the driving transistor in a diode connection state.

In a driving method of a display apparatus, the display apparatus includes: a light-emitting device; a pixel circuit which is connected to the light-emitting device; a display driver having a voltage adjustment section; and a data line which connects the display driver and pixel circuit, and the voltage adjustment section adjusting the potential of an adjustment voltage such that the potential thereof is approximated to a potential which is changed in accordance with the change amount of the characteristics inherent to the pixel circuit when a reference current having a predetermined current value is supplied to the pixel circuit.

A display driver according to present invention includes: a voltage adjustment section which adjusts the potential of an adjustment voltage such that the potential thereof is approximated to a potential which is changed in accordance with the change amount of the characteristics inherent to a pixel circuit connected to a light-emitting device when a reference current having a predetermined current value is supplied to the pixel circuit.

A driving method of a display driver according to the present invention adjusts voltage for activating display driver such that the potential thereof is approximated to a potential which is changed in accordance with the change amount of the characteristics of a pixel circuit connected to a light-emitting device when a reference current having a predetermined current value is supplied to the pixel circuit.

DETAILED DESCRIPTION OF THE PREFERRED EMBODIMENTS

A display driver and method for driving the same, and, a display apparatus and method for driving the same will be described in detail below through an embodiment thereof.

<Main Configuration of Display Pixel>

First, a main configuration of a display pixel applied to a display apparatus according to the present invention and its control operation will be described with reference to the accompanying drawings.

Figure 1:
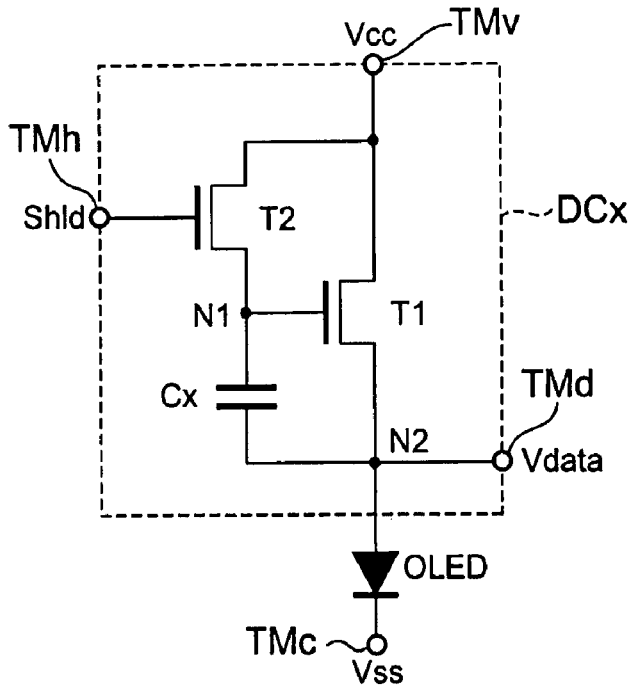
FIG. 1 is an equivalent circuit diagram showing a configuration of the main part of a display pixel which is applicable to a display apparatus according to the present invention.

FIG. 1 is an equivalent circuit diagram showing a configuration of the main part of a display pixel which is applied to a display apparatus according to the present invention. In this example, an organic EL device is used as a current-drive type light-emitting device to be provided in a display pixel for descriptive purposes.

As shown in FIG. 1, a display pixel applied to a display apparatus according to the present invention has a circuit configuration including a pixel circuit section (corresponding to a pixel drive circuit DC to be described later) DCx and an organic EL device OLED which is a current-drive type light-emitting device. The pixel circuit section DCx has, e.g., a driving transistor T1 (first switching device), a holding transistor T2 (second switching device), and a capacitor (voltage holding device) Cx. The drain terminal of the driving transistor T1 is connected to a power supply terminal TMv, source terminal thereof is connected to a node N2, and gate terminal thereof is connected to a node N1. The drain terminal of the holding transistor T2 is connected to the power supply terminal TMv (drain terminal of the driving transistor T1), source terminal thereof is connected to the node N1, and gate terminal thereof is connected to a control terminal TMh. The capacitor Cx is connected between the gate and source terminals (between the nodes N1 and N2) of the driving transistor T1. The organic EL device OLED has an anode terminal to which the node N2 is connected and a cathode terminal TMc.

As explained in control operation, which will be described later, a power voltage Vcc whose voltage value is changed in accordance with the operating state of the display pixel (pixel circuit section DCx) is applied to the power supply terminal TMv. A power supply voltage Vss is applied to the cathode terminal TMc of the organic EL device OLED. A hold control signal Shld whose voltage value is changed in accordance with the operating state of the display pixel is applied to the control terminal TMh. A data voltage Vdata corresponding to the gradation value of display data is applied to a data terminal TMd connected to the node N2.

The capacitor Cx may be a parasitic capacitance that is formed between the gate and source of the driving transistor T1 or may be a capacitance in which a capacitance device is further connected between the nodes N1 and N2 in parallel in addition to the parasitic capacitance. Although the device structures and characteristics of the driving transistor T1 and holding structure T2 are not particularly limited, an n-channel type thin-film transistor is used as the transistors T1 and T2.

<Control Operation In Display Pixel>

Next, control operation (control method) in the display pixel (pixel circuit section DCx and organic EL device OLED) having the configuration described above will be described.

Figure 2:
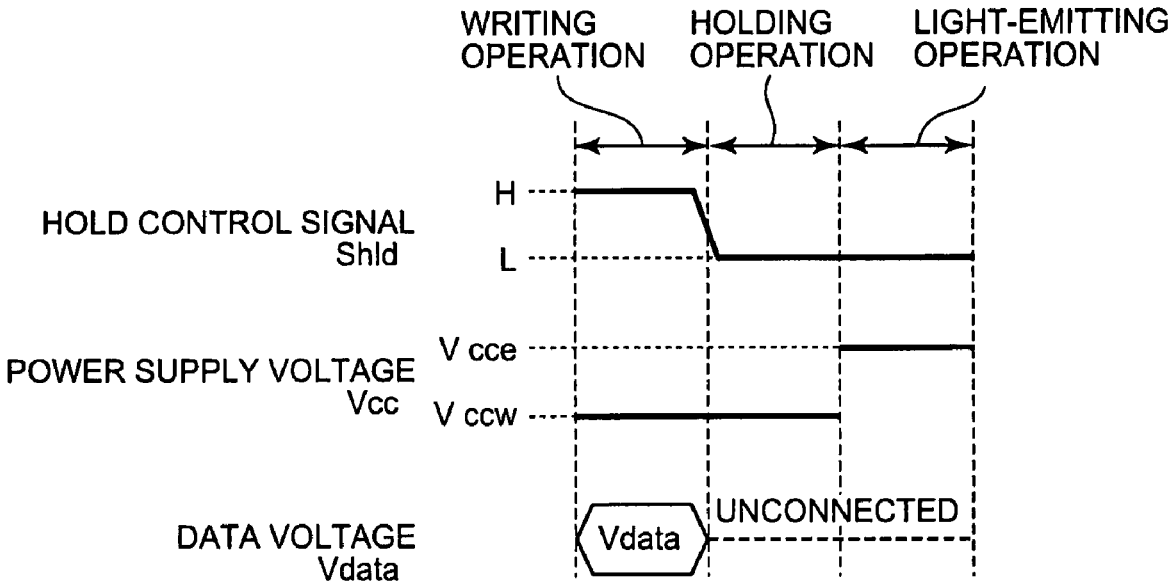
FIG. 2 is a signal waveform diagram showing control operation of a display pixel applied to a display apparatus according to the present invention.

FIG. 2 is a signal waveform diagram showing control operation of the display pixel applied to the display apparatus according to the present invention.

As shown in FIG. 2, the operating state in the display pixel (pixel circuit section DCx) having the circuit configuration as shown in FIG. 1 can roughly divided into three states: writing state, holding state, and light-emitting state. In the writing state, the display device writes a voltage component corresponding to the gradation value of display data in the capacitor Cx. In the holding state, the display device holds the voltage component written through the writing operation in the capacitor Cx. In the light-emitting state, the display device causes a gradation current corresponding to the gradation value of display data to flow in the organic EL device OLED on the basis of the voltage component held through the holding operation to thereby allow the organic EL device OLED to emit light at a luminance gradation corresponding to display data. In the following, details of the respective operating states will be described with reference to a timing chart shown in FIG. 2.

(Writing Operation)

In the writing operation, the display device writes a voltage component corresponding to the gradation value of display data in the capacitor Cx in a state in which the organic EL device OLED is not allowed to emit light (off state).

Figure 3A:
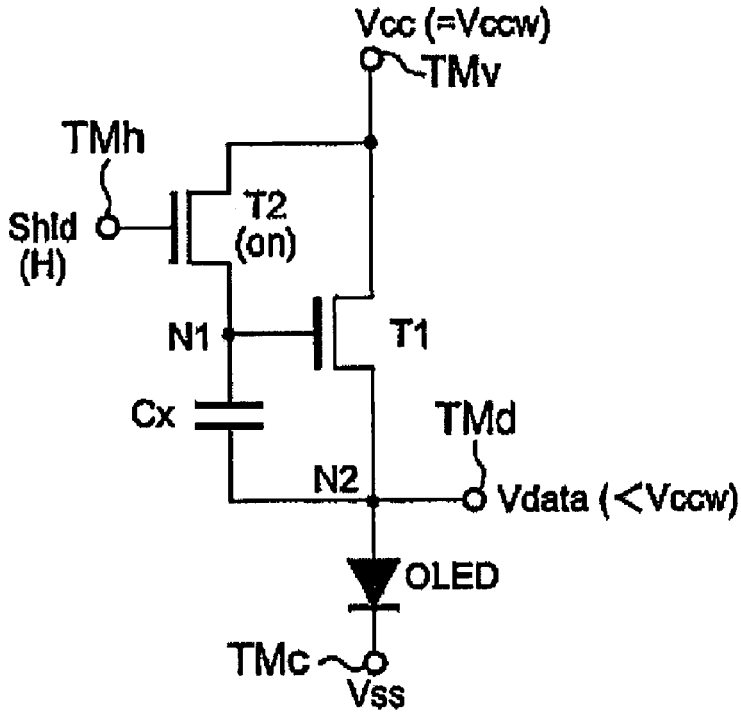
FIGS. 3A and 3B are views for schematically explaining an operating state of a display pixel at the time of writing operation.
Figure 3B:
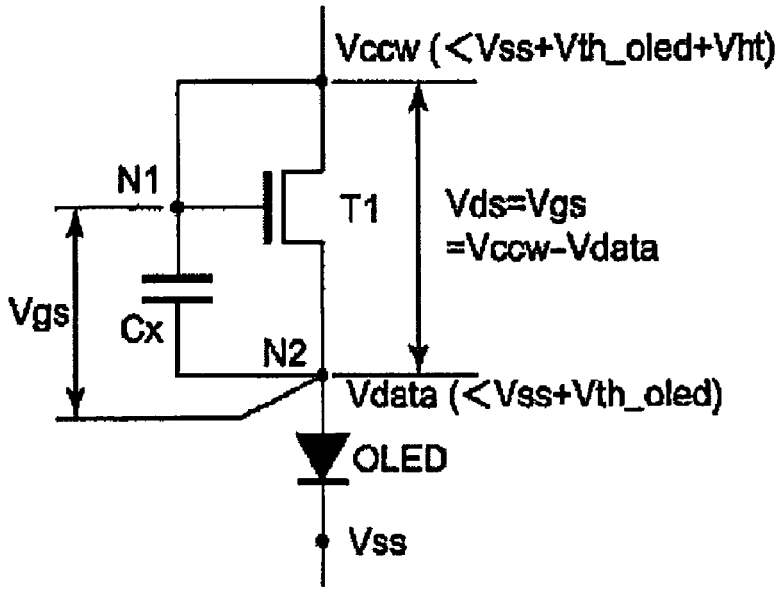
Figure 4A:
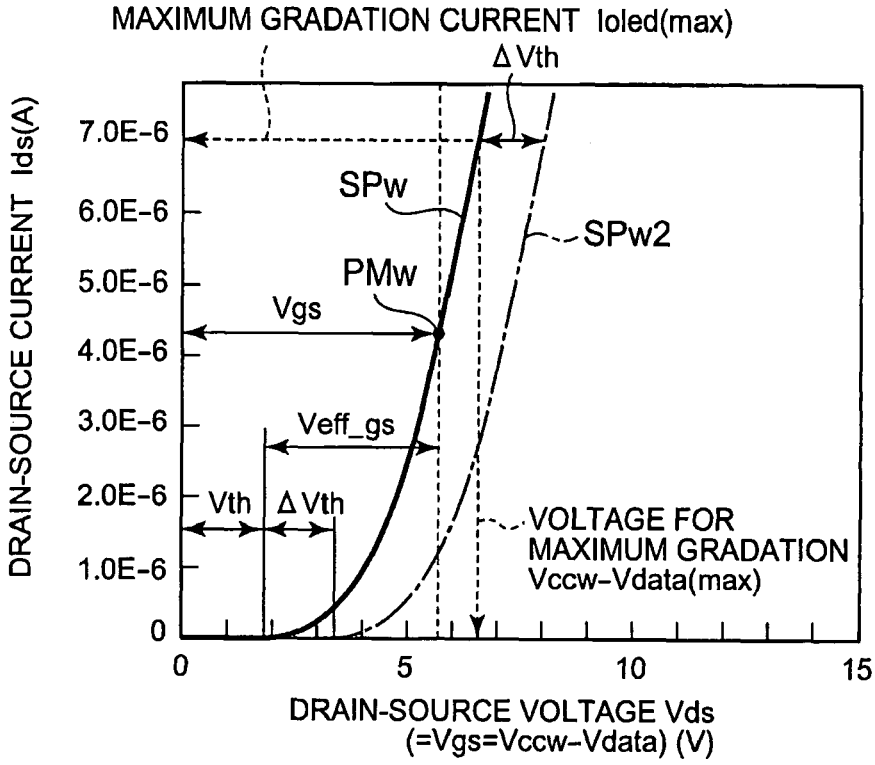
FIG. 4A is a view showing operating characteristics of a driving transistor of a display pixel at the time of writing operation.
Figure 4B:
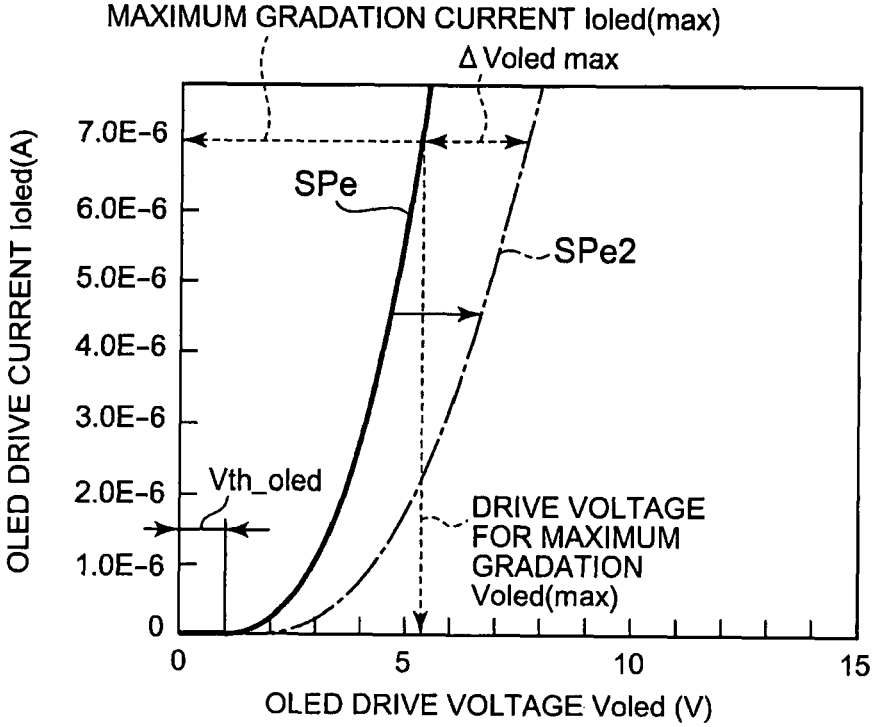
FIG. 4B is a view showing operating characteristics of an OLED at the time of writing operation.

FIGS. 3A and 3B are views for schematically explaining the operating state of the display pixel at the time of the writing operation. FIG. 4A is a characteristic view showing operating characteristics of the driving transistor of the display pixel at the time of writing operation, and FIG. 4B is a characteristic view showing a relationship between the drive current and drive voltage of the organic EL device. A solid-line curve SPw is a characteristic curve representing a relationship between a drain-source voltage Vds and a drain-source current Ids in the initial state in the case where an n-channel type thin-film transistor is used as the driving transistor T1 and where the driving transistor T1 has a diode connection configuration. A dotted-line curve SPw2 represents an example of a characteristic curve obtained in the case where a characteristic change occurs depending on the drive history of the driving transistor T1. The details will be described later. A point PMw on the characteristic curve SPw represents the operating point of the driving transistor T1.

The characteristic curve SPw shown in FIG. 4A has a threshold value Vth for the drain-source current Ids. When the drain-source voltage Vds exceeds the threshold value Vth, the drain-source current Ids nonlinearly increases with an increase of the drain-source voltage Vds. That is, a value indicated by Veff_gs is a voltage component that effectively forms the drain-source current Ids. Therefore, the drain-source voltage Vds is equal to the sum of the threshold value Vth and voltage component Veff_gs, as shown in the following expression (1).

$$Vds = Vth + Veff_gs \quad (1)$$

A solid-line curve SPe shown in FIG. 4B is a characteristic curve representing a relationship between a drive voltage Voled and drive current Ioled of the organic EL device OLED in the initial state. A dot and dash-line curve SPe2 represents an example of a characteristic curve obtained in the case where a characteristic change occurs depending on the drive history of the organic EL device OLED. The details will be described later. The characteristic curve SPe has a threshold value voltage Vth_oled for the drive voltage Voled. When the drive voltage Voled exceeds the threshold value voltage Vth_oled, the drive current Ioled nonlinearly increases with an increase of the drive voltage Voled.

In the writing operation, as shown in FIG. 2 and FIG. 3A, an on-level (high-level) hold control signal Shld is applied to the control terminal TMh of the holding transistor T2 to turn ON the holding transistor T2. As a result, the gate and drain of the driving transistor T1 are connected (short-circuited) to each other, and the driving transistor T1 is set in a diode connection state.

Subsequently, a first power supply voltage Vccw for writing operation is applied, and data voltage Vdata corresponding to the gradation value of display data is applied to the data terminal TMd. At this time, a current Ids corresponding to a potential difference (Vccw−Vdata) between the drain and source of the driving transistor T1 flows therebetween. This data voltage Vdata is set such that the current Ids flowing between the drain and source to allow the organic EL device OLED to emit light at a luminance gradation corresponding to the gradation value of display data.

Since the driving transistor T1 is set in a diode connection state, the drain-source voltage Vds of the driving transistor T1 is equal to the gate-source voltage Vgs, as shown in FIG. 3B. This is represented by the following expression (2).

$$Vds=Vgs=Vccw-V\text{data} \quad (2)$$

This gate-source voltage Vgs is written (charged) in the capacitor Cx.

Here, a condition required to set the value of the first power supply voltage Vccw will be described. The driving transistor T1 is an n-channel type, so that the gate potential of the driving transistor T1 must be positive relative to the source potential in order to allow the drain-source current Ids to flow. Here, the gate potential is equal to the drain potential and to first power supply voltage Vccw, and source potential is equal to the data voltage Vdata. Therefore, a relationship represented by the following expression (3) must be established between the data voltage Vdata and first power supply voltage Vccw at the writing time.

$$V\text{data}<Vccw \quad (3)$$

The node N2 is connected to the data terminal TMd as well as to the anode terminal of the organic EL device OLED. In order to turn the organic EL device OLED into an off state in the writing time, the potential Vdata of the node N2 needs to be a value not more than a value obtained by adding the threshold value voltage Vth_oled of the organic EL device OLED to the voltage Vss of the cathode side terminal TMc of the organic EL device OLED. That is, the potential Vdata of the node N2 must satisfy the following expression (4) at the writing time.

$$V\text{data}\leqq Vss+Vth_oled \quad (4)$$

Assuming that the Vss is set to a ground potential 0V, the following expression (5) is obtained.

$$\text{Vdata}\leqq\text{Vth_oled} \quad (5)$$

The following expression (6) can be obtained from the above expressions (2) and (5).

$$Vccw-Vgs\leqq Vth_oled \quad (6)$$

Further, as can be understood from the above expression (1), Vgs=Vds=Vth+Veff_gs, the following expression (7) is obtained.

$$Vccw\leqq Vth_oled+Vth+Veff_gs \quad (7)$$

The above expression (7) must be established even when Veff_gs=0, and assuming that Veff_gs=0, the following expression (8) can be obtained.

$$V\text{data}<Vccw\leqq Vth_oled+Vth \quad (8)$$

That is, during the wiring operation, the value of the first power supply voltage Vccw must be set to a value that satisfies the above expression (8) in a state where the driving transistor T2 is diode connected. The influence of characteristic changes of the driving transistor T1 and organic EL device OLED, which occur depending on the drive history, will next be described. It is known that the threshold voltage Vth of the driving transistor T1 increases depending on the drive history. The dotted-line curve SPw2 shown in FIG. 4A shows an example of a characteristic curve obtained in the case where a characteristic change occurs depending on the drive history. ΔVth represents the change amount of the threshold value voltage Vth. As shown in FIG. 4A, along with the characteristic change, the characteristic curve of the driving transistor T1 is moved nearly in parallel to the initial characteristic curve in such a direction as to increase the voltage. Therefore, in order to obtain a gradation current (drain-source current Ids) corresponding to the gradation value of display data, it is necessary to increase the value of the data voltage Vdata by the change amount ΔVth of the threshold value voltage Vth.

Further, it is known that the resistance of the organic EL device OLED becomes higher depending on the drive history. The dot and dash-line curve SPe2 shown in FIG. 4B represents an example of a characteristic curve obtained in the case where a characteristic change occurs depending on the drive history. As shown in FIG. 4B, along with the characteristic change resulting from the increase in the resistance, the characteristic curve of the organic EL device OLED is moved relative to the initial characteristic curve nearly in such a direction as to reduce the increasing rate of the drive current Ioled relative to the drive voltage Voled. That is, the drive voltage Voled increases by the amount corresponding to (characteristic curve SPe2−characteristic curve SPe) so as to supply the drive current Ioled required for the organic EL device OLED to emit light at a luminance gradation corresponding to the gradation value of display data. As indicated by ΔVoled max in FIG. 4B, this increase becomes maximum at the time of the maximum gradation at which the drive current Ioled assumes a maximum value Ioled (max).

(Holding Operation)

Figure 5A:
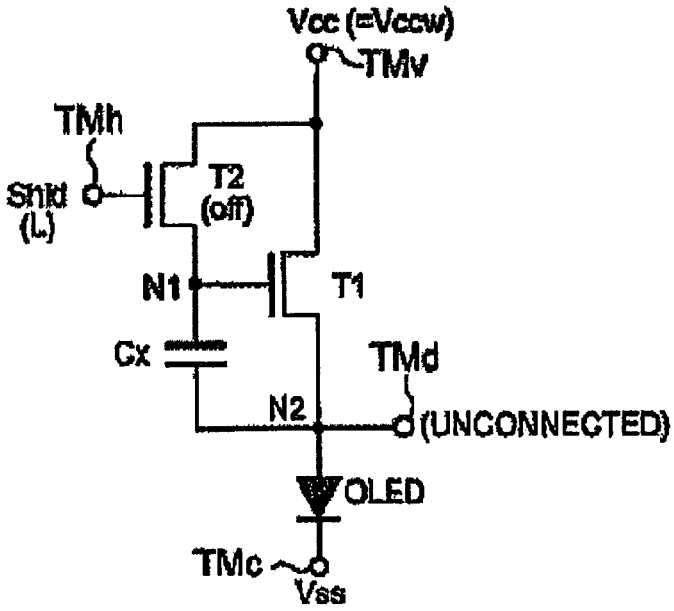
FIGS. 5A and 5B are views for schematically explaining an operating state of a display pixel at the time of holding operation.
Figure 5B:
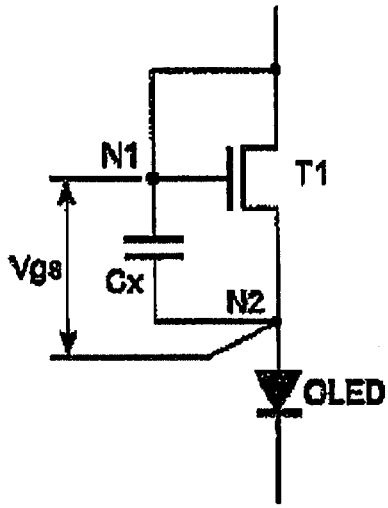
Figure 6:
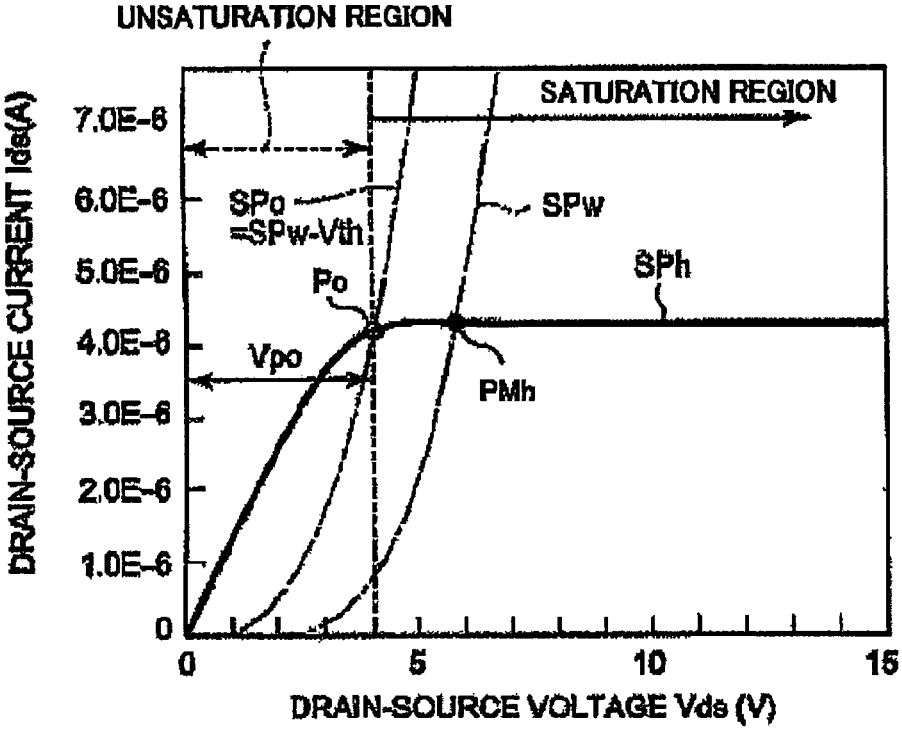
FIG. 6 is a view showing operating characteristics of a driving transistor at the time of holding operation.

FIGS. 5A and 5B are views for schematically explaining an operating state of the display pixel at the time of holding operation, and FIG. 6 is a characteristic view showing operating characteristics of the driving transistor at the time of the holding operation of the display pixel. In the holding operation, as shown in FIG. 2 and FIG. 5A, the display device applies an off-level (low-level) hold control signal Shld to the control terminal TMh to turn OFF the holding transistor T2 to thereby break the connection between the gate and drain of the driving transistor T1 so as to release the diode connection state. Through the above operation, as shown in FIG. 5B, the voltage Vds (=gate-source voltage Vgs) of the driving transistor T1 which has been charged in the capacitor Cx by the above writing operation is held.

A solid-line curve SPh shown in FIG. 6 represents a characteristic curve obtained in the case where the diode connection state of the driving transistor T1 is released to make the gate-source voltage Vgs constant. A dotted-line curve SPw shown in FIG. 6 is a characteristic curve obtained in the case where the driving transistor T1 is diode connected. An operating point PMh in the holding operation is defined by an intersecting point between the characteristic curve SPw when the diode connection is established and characteristic curve SPh obtained when the diode connection state is released.

A dot and dash line-curve SPo shown in FIG. 6 is obtained by (characteristic curve SPw−Vth). An intersecting point Po between the dot and dash-line curve SPo and characteristic curve SPh represents a pinch-off voltage Vpo. As shown in FIG. 6, with regard to the characteristic line SPh, the region from the point at which the drain-source voltage Vds assumes 0V to point at which the Vds assumes the pinch-off voltage Vpo is an unsaturation region within which the Ids increases with an increase of the Vds. On the other hand, the region in which the drain-source voltage Vds is equal to or greater than the pinch-off voltage Vpo is a saturation region in which Ids hardly increases even when the Vds increases.

(Light-Emitting Operation)

Figure 7A:
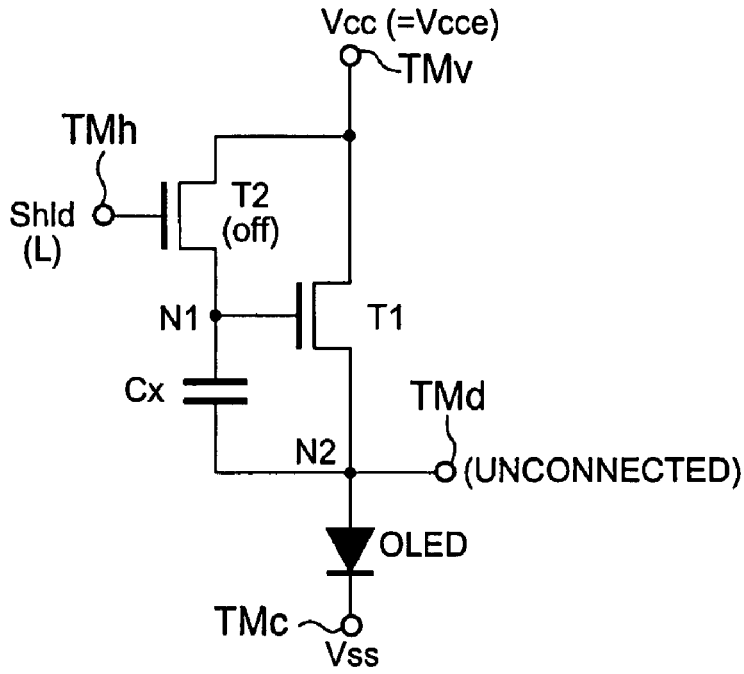
FIGS. 7A and 7B are views for schematically explaining an operating state of a display pixel at the time of light-emitting operation.
Figure 7B:
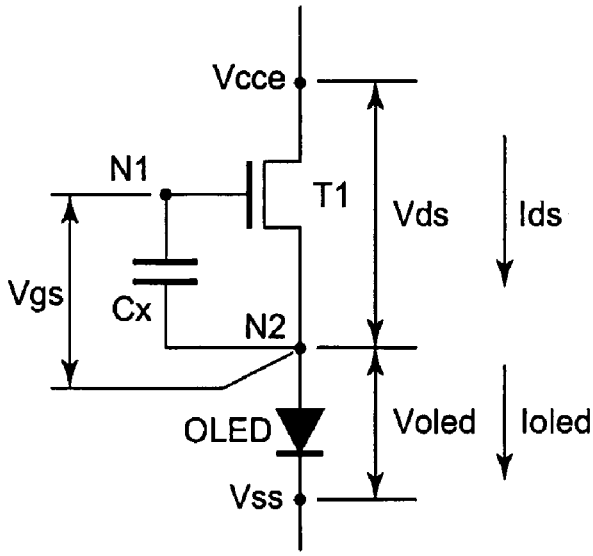
Figure 8A:
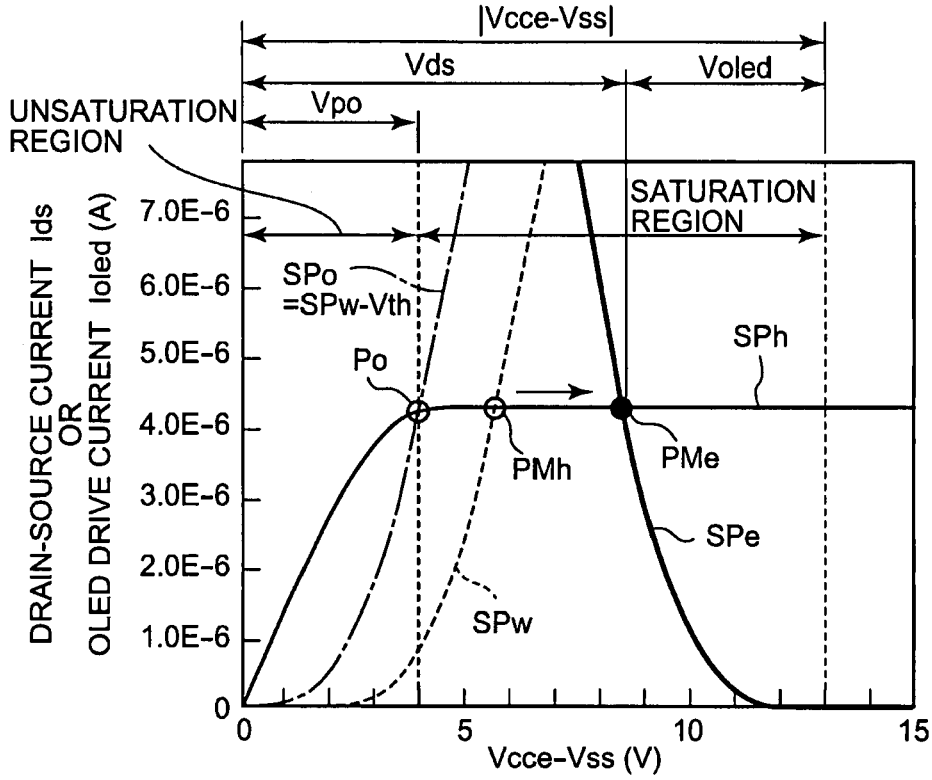
FIG. 8A is a view showing operating characteristics of a driving transistor and load characteristics of an organic EL device at the time of light-emitting operation.
Figure 8B:
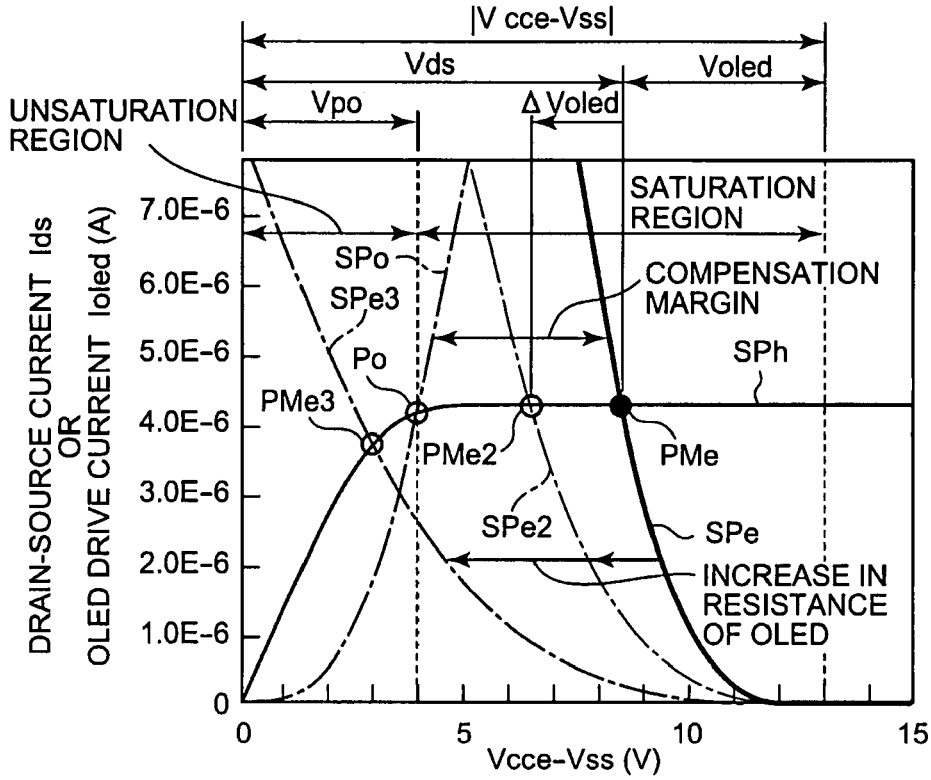
FIG. 8B is a view showing a change in an operating point when the resistance of an organic EL device becomes higher.

FIGS. 7A and 7B are views for schematically explaining an operating state of the display pixel at the time of light-emitting operation, and FIGS. 8A and 8B are characteristic views showing operating characteristics of the driving transistor and load characteristics of the organic EL device at the time of light-emitting operation.

As shown in FIG. 2 and FIG. 7A, the display device maintains a state in which the off-level (low-level) hold control signal Shld is applied to the control terminal TMh (a state in which the diode connection state is released). Further, the display device switches the terminal voltage Vcc of the power supply terminal TMv from the first power supply voltage Vccw for writing operation to a second power supply voltage Vcce for light-emission. As a result, as shown in FIG. 7B, the current Ids corresponding to the voltage component Vgs held in the capacitor Cx flows between the drain and source of the driving transistor T1. The current is supplied to the organic EL device OLED, causing the organic EL device OLED to emit light at a luminance corresponding to the value of the supplied current.

A solid-line curve SPh shown in FIG. 8A represents a characteristic curve of the driving transistor T1 obtained in the case where the gate-source voltage Vgs is made constant. A solid-line curve SPe represents a load characteristic curve of the organic EL device OLED. The solid-line curve SPe represents a potential difference between the power supply terminal TMv and cathode terminal TMc of the organic EL device OLED, that is, a characteristic curve obtained by (drive voltage Voled of the organic EL device OLED—drive current Ioled) is plotted reversely on the basis of the value obtained by (Vcce−Vss).

The operating point of the driving transistor T1 at the light-emitting operation is moved from the point PMh at the time of holding operation to a point PMe which is an intersection point between the characteristic curve SPh of the driving transistor T1 and load characteristic curve SPe of the organic EL device OLED. The operating point PMe represents, as shown in FIG. 8A, a point at which a voltage of Vcce−Vss is divided between the source-drain of the driving transistor T1 and anode-cathode of the organic EL device OLED in a state where the voltage of Vcce−Vss is applied between the power supply terminal TMv and cathode terminal TMc of the organic EL device OLED. That is, at the operating point PMe, the voltage Vds is applied between the source and drain of the driving transistor T1, and drive voltage Voled is applied between the anode and cathode of the organic EL device OLED.

In order not to change the values of the current Ids (expected current value) which is allowed to flow between the drain and source of the driving transistor T1 at the time of writing operation and drive current Ioled which is supplied to the organic EL device OLED at the time of light-emitting operation, the operating point PMe needs to exist within the saturation region on the characteristic curve. The Voled becomes maximum at the time of the maximum gradation. Therefore, in order to maintain the PMe within the saturation region, the value of the second power supply voltage Vcce must satisfy the following expression (9).

$$Vcce-Vss \geqq Vpo+Voled(\max) \quad (9)$$

Assuming that the Vss is set to a ground potential 0V, the following expression (10) is obtained.

$$Vcce \geqq Vpo+Voled(\max) \quad (10)$$

<Relationship Between Change in Organic Device Characteristics and Voltage-Current Characteristics>

As shown in FIG. 4B, the resistance of the organic EL device OLED becomes higher depending on the drive history with the result that the characteristic curve of the organic EL device OLED is moved in such a direction as to reduce the increasing rate of the drive current Ioled relative to the drive voltage Voled. That is, the load characteristic curve SPe shown in FIG. 8A is moved in such a direction as to reduce the inclination of the organic EL device OLED. FIG. 8B shows this change of the load characteristic curve SPe of the organic EL device OLED occurring depending on the drive history. As shown in FIG. 8B, the load characteristic curve is shifted, e.g., as SPe→SPe2→SPe3. Accordingly, the operating point of the driving transistor T1 is shifted on the characteristic curve SPe of the driving transistor T1 depending on the drive history as PMe→PMe2→PMe3.

At this time, the drive current Ioled maintains the expected current value at the writing operation time while the operating point exists within the saturation region on the characteristic curve (PMe→PMe2). However, when the operating point enters the unsaturation region (PMe3), the drive current Ioled falls below the expected current value at the writing operation time with the result that a display defect occurs. In FIG. 8B, a pinch-off point Po exists at the boundary between the unsaturation region and saturation region. That is, the potential difference between the operating points PMe and Po corresponds to a compensation margin for maintaining the OLED drive current at the light emitting time against an increase in the resistance of the organic EL. In other words, the potential difference between the potential on the trajectory SPo of the pinch-off point and potential on the load characteristic curve SPe of the organic EL device at each Ioled level corresponds to the compensation margin. As shown in FIG. 8B, the compensation margin decreases as the value of the drive current Ioled increases, whereas the compensation margin increases as the voltage of Vcce−Vss applied between the power supply terminal TMv and cathode terminal TMc of the organic EL device OLED increases.

<Relationship Between Change in TFT Device Characteristics and Voltage-Current Characteristics>

In voltage gradation control using a transistor applied to the above mentioned display pixel (pixel circuit section), the data voltage Vdata is set on the basis of drain-source voltage Vds-drain source current Ids characteristics of the transistor that has previously been set at the initial stage. However, when the threshold voltage Vth increases depending on the drive history as shown in FIG. 4A, the current value of a light-emission drive current to be supplied to a light-emitting device (organic EL device OLED) does not correspond to display data (data voltage), preventing the light-emitting device from performing light emitting operation with an adequate luminance gradation. It is known, in particular, that when an amorphous silicon transistor is employed as the transistor, a change in the device characteristics becomes prominent.

In the following, an example of the initial characteristics (voltage-current characteristics) of the drain-source voltage Vds and drain-source current Ids is shown. In this example, 256 gradation display is performed in an amorphous silicon transistor having design values shown in the following Table 1.

TABLE 1

| <Transistor design values> | |
|---|---|
| Gate insulating film thickness | 300 nm (3000 Å) |
| Channel width W | 500 μm |
| Channel length L | 6.28 μm |
| Threshold voltage Vth | 2.4 V |

In the voltage-current characteristic in an n-channel type amorphous silicon transistor, i.e., in the characteristic curve between the drain-source voltage Vds and drain-source current Ids shown in FIG. 4A, carrier trapping into the gate insulating film due to the change with the lapse of time or the drive history offsets the gate electric field, resulting in an increase of Vth (initial state: characteristic curve is shifted from SPw toward the high voltage side (to SPw2)). As a result, the drain-source current IDs decreases relative to the drain-source voltage Vds applied to the amorphous silicon transistor, resulting in a decrease of luminance gradation of the light-emitting device.

Such a change only occurs in the threshold voltage Vth. Therefore, the V-I characteristic curve SPw2 after the shift substantially corresponds to voltage-current characteristics obtained by uniquely adding (i.e., the V-I characteristic curve SPw is moved in parallel by an amount corresponding to ΔVth) a constant voltage (corresponding to an offset voltage Vofst to be described later) corresponding to the change amount ΔVth (about 2V, in FIG. 4A) of the threshold value voltage Vth to the drain-source voltage Vds of the V-I characteristic curve SPw in the initial state.

In the writing operation of display data in the display pixel (pixel circuit section DCx), a data voltage (corresponding to a correction gradation voltage Vpix to be described later) compensated by adding a constant voltage (offset voltage Vofst) corresponding to the change amount ΔV of the device characteristics (threshold voltage) of the driving transistor T1 provided in the display pixel is applied to the source terminal (node N2) of the driving transistor. This voltage application allows the shift of the V-I characteristics resulting from the change in the threshold voltage Vth of the driving transistor T1 to be compensated. This compensation allows a drive current Iem having a current value corresponding to display data to flow in the organic EL device OLED, thereby allowing the organic EL device OLED to emit light at a desired luminance gradation.

The holding operation for switching the hold control signal Shld from on-level to off-level and light-emitting operation for switching the power supply voltage Vcc from the voltage Vccw to voltage Vcce may be performed in sync with each other.

A configuration of the display apparatus having a display panel in which a plurality of display pixels including the abovementioned main configuration of the pixel circuit section are two-dimensionally arranged will concretely be described with reference to the drawings showing the entire configuration thereof.

<Display Apparatus>

Figure 9:
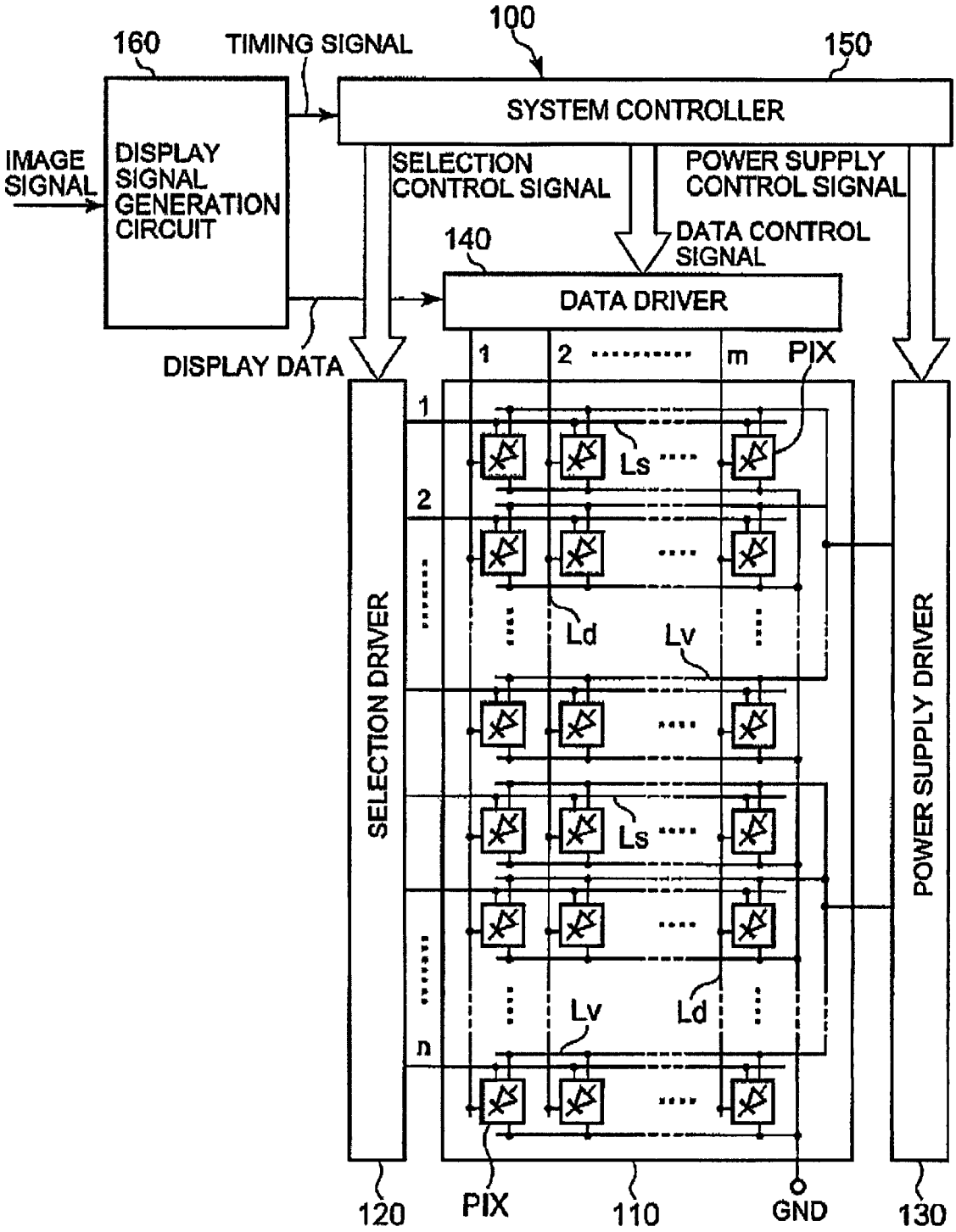
FIG. 9 is a schematic configuration view showing an embodiment of a display apparatus according to the present invention.
Figure 10:
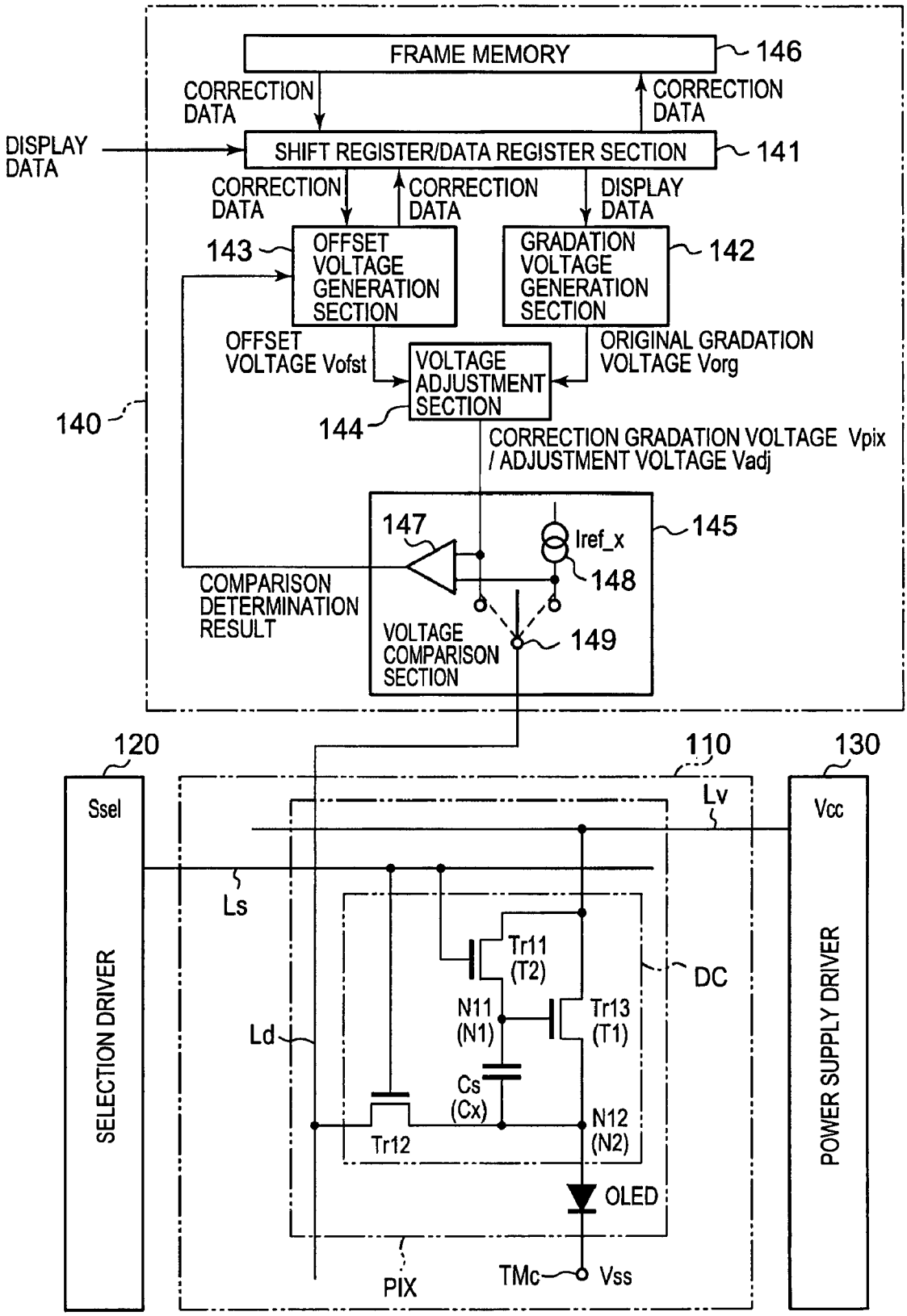
FIG. 10 is a view showing an example of a main configuration of data driver and display pixel (pixel drive circuit and light-emitting device) which can be applied to a display apparatus according to the present embodiment.

FIG. 9 is a schematic configuration view showing an embodiment of the display apparatus according to the present invention. FIG. 10 is a view showing an example of a main configuration of data driver and display pixel (pixel drive circuit and light-emitting device) which can be applied to the display apparatus according to the present embodiment. FIG. 10 includes reference symbols of a circuit configuration corresponding to the abovementioned pixel circuit section DCx (see FIG. 1). Further, although all of the various signals or data, and, currents and voltages to be applied are represented by arrows for the sake of convenience in FIG. 10, it is not necessarily the case that they are simultaneously transmitted or applied.

As shown in FIGS. 9 and 10, a display apparatus 100 according to the present embodiment includes, e.g., a display panel 110, a selection driver (selection drive section) 120, a power supply driver (power supply drive section) 130, a data driver (display driver, data drive section) 140, a system controller 150, and a display signal generation circuit 160. The display panel 110 has a plurality of display pixels PIX arranged in a matrix form of n rows×m columns (n and m are arbitrary integer numbers), each of the plurality of display pixels including the above mentioned main part configuration of the pixel circuit section DCx (see FIG. 1) in the vicinity of each intersection of a plurality of selection lines Ls arranged in a row direction (horizontal direction in the drawings) and a plurality of data lines Ld arranged in a column direction (vertical direction in the drawings). The selection driver 120 is a driver for applying a selection signal Ssel at a predetermined timing to each of the selection lines Ls. The power supply driver 130 is a driver for applying a power supply voltage Vcc on a predetermined voltage level at a predetermined timing to each of power supply voltage lines Lv arranged in a row direction in parallel with the selection lines Ls. The data driver 140 is a driver for supplying a gradation signal (correction gradation voltage Vpix) at a predetermined timing to each of the data lines Ld. The system controller 150 is a unit that generates and outputs a selection control signal, a power supply control signal and a data control signal for controlling an operating state of at least the selection driver 120, the power supply driver 130, and the data driver 140 on the basis of a timing signal supplied from a display signal generation circuit 160 which will be described later. The display signal generation circuit 160 generates display data (luminance gradation data) including digital signals on the basis of an image signal supplied from the outside of the display apparatus 100 to supply the data to the data driver 140. Further, the display signal generation circuit 160 extracts or generates a timing signal (a system clock or the like) for displaying predetermined image information on the display panel 110 on the basis of the display data to supply the timing signal to the system controller 150.

Hereinafter, there will be concretely explained each of the configurations.

(Display Panel)

In the display apparatus 100 according to the present embodiment, the plurality of display pixels PIX which are arranged in a matrix form on a substrate of the display panel 110 are divided into an upper area and a lower area of the display panel 110, as shown in FIG. 9. Further, as shown in FIG. 9, the display pixels PIX in each group are individually connected to a branched power supply voltage line Lv. A power supply voltage Vcc is applied in common to the upper area display pixels PIX of 1 st to n/2-th rows. Likewise, a power supply voltage Vcc is applied in common to the lower area display pixels PIX of 1+n/2-th to n-th rows. The power supply voltage Vcc to be applied in common to the upper area and power supply voltage Vcc to be applied in common to the lower area are output, in an independent manner, through different power supply voltage lines Lv at different timings by the power supply driver 130. The selection driver 120 and data driver 140 may be provided in the display panel 110.

Depending on the situation, the selection driver 120, power supply driver 120, and data driver 140 may be provided in the display panel 110.

(Display Pixel)

The display pixel PIX applied to the present embodiment is disposed in the vicinity of each intersection of the selection lines Ls connected to the selection driver 120 and the data lines Ld connected to the data driver 140. For example, as shown in FIG. 10, the display pixel PIX has an organic EL device OLED which is a current-drive type light-emitting device and a pixel drive circuit DC. The pixel drive circuit DC includes the above mentioned main configuration of the pixel circuit section DCx (see FIG. 1) and is configured to generate a light-emission drive current for allowing the organic EL device OLED to emit light.

The pixel drive circuit DC has, e.g., a transistor Tr11 (transistor for diode connection), a transistor Tr12 (selection transistor), a transistor Tr13 (driving transistor), and a capacitor (voltage holding device) Cs. The gate terminal of the transistor Tr11 is connected to the selection line Ls, drain terminal thereof is connected to the power supply voltage line Lv, and source terminal thereof is connected to a node N11. The gate terminal of the transistor Tr12 is connected to the selection line Ls, source terminal thereof is connected to a data line Ld, and drain terminal thereof is connected to a node N12. The gate terminal of the transistor Tr11 is connected to the node N11, drain terminal thereof is connected to the power supply voltage line Lv, and source terminal thereof is connected to the node N12. The capacitor (voltage holding device) Cs is connected between the node N11 and node N12 (between gate and source terminals of the transistor Tr13).

The transistor Tr13 corresponds to the driving transistor T1 shown in the abovementioned main configuration (FIG. 1) of the pixel circuit section DCx, transistor Tr11 corresponds to the holding transistor T2, capacitor Cs corresponds to the capacitor Cx, and nodes N11 and N12 correspond to the nodes N1 and N2. The selection signal Ssel applied from the selection driver 120 to selection line Ls corresponding to the abovementioned hold control signal Shld, and gradation signal (correction gradation voltage Vpix) applied from the data driver 140 to the data line Ld corresponds to the abovementioned data voltage Vdata.

The anode terminal of the organic EL device OLED is connected to the node N12 of the pixel drive circuit DC. A reference voltage Vss which is a constant low voltage is applied to the cathode terminal TMc of the organic EL device OLED. In drive control operation (to be described later) of the display apparatus, during the writing operation time during which a gradation signal (correction gradation voltage Vpix) corresponding to display data is supplied to the pixel drive circuit DC, the correction gradation voltage Vpix applied from the data driver 140, reference voltage Vss, and high-potential power supply voltage Vcc (=Vcce) which is applied to the power supply voltage line Lv during the light-emitting operation satisfy the above expressions (3) to (10). Therefore, the organic EL device OLED does not emit light during the writing operation time.

The capacitor Cs may be a parasitic capacitance that is formed between the gate and source of the transistor Tr13, or may be a capacitance in which capacitance device other than the transistor Tr13 is further connected between the nodes N11 and N12 in addition to the parasitic capacitance.

The transistors Tr11 to Tr13 are not particularly limited. However, an n-channel type of amorphous silicon TFT (thin-film transistor) can be applied by composing the all of the transistors Tr11 to Tr13 by an n-channel type FET (field-effect transistor). In this case, by applying an amorphous silicon manufacturing technology that has been already established, it is possible to manufacture the pixel drive circuit DC constituted by the amorphous silicon TFT whose device characteristics (electronic mobility) are stable, in a relatively easy manufacturing process. In the following description, it is assumed that an n-channel type TFT is employed as the transistor Tr11 to Tr13.

Further, the circuit configuration of the display pixel PIX (pixel drive circuit DC) is not limited to that shown in FIG. 10, and the display pixel PIX may have any other circuit configurations as long as it includes at least the devices as shown in FIG. 1, such as the driving transistor T1, holding transistor T2, and capacitor Cx, and a current path of the driving transistor T1 is connected in series to a current-drive type light-emitting device (organic EL device OLED). Further, the light-emitting device which is allowed to emit light by the pixel drive circuit DC is not limited to the organic EL device OLED and it is possible to employ any other drive-current type light-emitting device, such as a light-emitting diode.

(Selection Driver)

The selection driver 120 sets the display pixels PIX in each row in a selection state by applying a selection level (a high level in the display pixel PIX shown in FIGS. 12 and 13) selection signal Ssel to each of the selection lines Ls on the basis of the selection control signal supplied from the system controller 150. Specifically, the display pixels PIX in each row are sequentially set in a selection state by sequentially performing for each row at a predetermined timing an operation of applying the selection signal Ssel to the selection line Ls of the row in a period in which a correction data acquisition operation (to be described later) and writing operation are performed with respect to the display pixels PIX in each row.

Here, for example, the selection driver 120 includes a shift register and an output circuit section (output buffer). The shift register sequentially outputs a shift signal corresponding to the selection line Ls of each row on the basis of the selection control signal supplied from the system controller 150 to be described later. The output circuit section converts the shift signal into a predetermined signal level (selection level) and sequentially outputs the signal as the selection signal Ssel to each selection line Ls. If the drive frequency of the selection driver 120 lies within a range that allows the amorphous silicon transistor to operate, a part or all of transistors included in the selection driver 120 may be produced together with the transistors Tr11 to Tr13 in the display pixel drive circuit DC.

(Power Supply Driver)

The power supply driver 130 applies, on the basis of the power supply control signal supplied from the system controller 150, a low-potential power supply voltage Vcc (=Vccw: first power supply voltage) to each power supply voltage line Lv at least in a period in which a correction data acquisition operation (to be described later) and writing operation are performed. Further, the power supply driver 130 applies a high-potential power supply voltage Vcc (=Vcce: second power supply voltage) having a higher potential than the first power supply voltage Vccw to each power supply voltage line Lv during the light-emitting operation.

As described above, in the present embodiment, the display pixels PIX are divided into an upper area and a lower area of the display panel 110, and the display pixels PIX in each group are individually connected to a branched power supply voltage line Lv. Therefore, during the above respective operation time, a power supply voltage Vcc having the same voltage level is applied to the display pixels PIX arranged in the same region (belonging to the same group) through a power supply voltage line Lv branched to the relevant region.

The power supply driver 130 may includes, for example, a timing generator and an output circuit section. The timing generator generates a timing signal corresponding to the power supply voltage line Lv of each region (group) on the basis of the power supply control signal supplied from the system controller 150. For example, a shift register or the like for sequentially outputting a shift signal is used as the timing generator. The output circuit section converts the timing signal into a predetermined voltage level (voltage values Vccw, Vcce) and outputs the resultant signal to the power supply voltage line Lv of each region as the power supply voltage Vcc.

(Data Driver)

The data driver 140 detects a specified value (offset setting value Vofst) corresponding to the change amount of device characteristics (threshold voltage) of the transistor Tr13 (corresponding to the driving transistor T1) for light-emission drive which is provided for each display pixel PIX (pixel drive circuit DC) arranged on the display panel 110. The data driver 140 stores the detected specified value as correction data for each display pixel PIX. The data driver 140 compensates a signal voltage (original gradation voltage Vorg) corresponding to display data (luminance gradation value) for each display pixel PIX supplied from the display signal generation circuit 160 to be described later on the basis of the correction data to generate a correction gradation voltage Vpix. The data driver 140 supplies the generated correction gradation voltage Vpix to each display pixel PIX through the data line Ld.

As shown in FIG. 10, the data driver 140 includes a shift register/data register section (gradation data transfer section, specified value transfer section, correction data transfer section) 141, a gradation voltage generation section (gradation voltage generation section) 142, an offset voltage generation section (specified value detection section, variable setting section, specified value extraction section, compensation voltage generation section) 143, a voltage adjustment section (gradation voltage correction section, adjusted voltage generation section) 144, a voltage comparison section (specified value detection section, voltage comparison section) 145, and a frame memory (storage section) 146. The gradation voltage generation section 142, offset voltage generation section 143, voltage adjustment section 144, and voltage comparison section 145 are provided for the data line Ld of each column and, therefore, m-sets of these sections are provided in the display apparatus 100 of the present embodiment. Although the frame memory 146 is incorporated in the data driver 140 in the present embodiment as shown in FIG. 10, the present invention is not limited thereto, and the frame memory 146 may be independently provided outside the data driver 140.

The shift register/data register section 141 includes, for example, a shift register and data register. The shift register sequentially outputs a shift signal on the basis of the data control signal supplied from the system controller 150. The data register transfers display data supplied from the display signal generation circuit 160 to the gradation voltage generation section 142 provided for each column on the basis of the shift signal and fetches correction data output from the offset voltage generation section 143 provided for each column and outputs the data to the frame memory 146. Further, the data register fetches the correction data output from the frame memory 146 at the time of the writing operation and correction data acquisition operation and transfers the correction data to the offset voltage generation section 143.

The shift register/data register section 141 swichingly executes one of the following three operations: (1) sequentially fetches display data (luminance gradation value) corresponding to display data of the display pixels PIX of one row which is supplied as serial data from the display signal generation circuit 160 and transfers the display data to the gradation voltage generation section 142 provided for each column; (2) fetches, on the basis of a result of comparison determination made in the voltage comparison section 145, correction data corresponding to the change amount of the device characteristic (threshold voltage) of the transistors Tr13 and Tr12 of each display pixel PIX (pixel drive circuit DC) which are output from the offset voltage generation section 143 provided for each column and sequentially transfers the correction data to the frame memory 146; and (3); sequentially fetches the compensation data of the display pixels PIX of specified row one from the frame memory 146 and transfers the correction data to the offset voltage generation section 143 provided for each column. The details of these operations will be described later.

The gradation voltage generation section 142 generates an original gradation voltage Vorg on the basis of the display data of each display pixel PIX fetched through the shift register/data register section 141 and outputs the original gradation voltage Vorg to the voltage adjustment section 144. The original gradation voltage Vorg is a voltage value for allowing the organic EL device OLED to emit light at a predetermined luminance gradation or to emit no light (black display operation).

For generating the original gradation voltage Vorg having a voltage value corresponding to display data, a combination of a digital-analog converter (D/A converter) and an output circuit may be employed. The digital-analog converter converts a digital signal voltage of the display data into an analog signal data on the basis of a gradation reference voltage (reference voltage corresponding to the number of gradations of a luminance gradation value included in the display data) supplied from a not shown voltage supply section. The output circuit outputs the analog signal voltage as the original gradation voltage Vorg at a predetermined timing.

The gradation voltage generation section 142 may automatically output the original gradation voltage Vorg to the voltage adjustment section 144 without receiving the input from the shift register/data register section 141. For example, in a state where the transistor Tr13 assumes the V-I characteristic curve SPw, the gradation voltage generation section 142 may set the logic voltage between the power supply voltage line Lv and data line Ld obtained when a reference current Iref_x (to be described later) having x-th gradation flows in the transistor Tr13 as the original gradation voltage Vorg.

The offset voltage generation section 143 generates and outputs an offset voltage (compensation voltage) Vofst corresponding to the change amount (corresponding to ΔVth shown in FIG. 4A) of the threshold voltage of the transistor Tr13 provided for each display pixel PIX (pixel drive circuit DC) on the basis of the correction data fetched from the frame memory 146. The generated offset voltage (compensation voltage) Vofst is a voltage obtained when the data driver 140 is driven by a drawing current to be described later, i.e., a voltage obtained when a current flows to the data driver 140 through the drain-source of the transistor Tr13, drain-source of the transistor Tr12, and data line Ld. Therefore, the offset voltage Vofst assumes a value that satisfies the following expression (11) at the time of the writing operation.

$$Vofst = Vunit \times Minc \tag{11}$$

where a unit voltage Vunit is a previously set minimum voltage unit and having a negative potential, and offset setting value Minc is digital correction data read out from the frame memory 146.

An application of the offset voltage Vofst allows a compensating gradation current, which has been approximated to a current value corresponding to a proper gradation by the compensating gradation voltage Vpix, to flow between the drain and source of the transistor Tr13. The offset voltage Vofst is set to a value obtained by compensating the change amounts of the threshold voltage of the transistor Tr13 and threshold value of the transistor Tr12 provided for each display pixel (pixel drive circuit DC) in order for the compensating gradation current to flow.

In the correction data acquisition operation executed before the writing operation, the value of an offset setting value (variable) Minc to be multiplied with the unit voltage Vunit is changed for optimization until the offset setting value (variable) Minc becomes to an appropriate value. Specifically, the offset voltage generation section 143 generates an offset voltage Vofst according to the value of the initial offset setting value Minc. Then, the offset voltage generation section 143 outputs the offset setting value Minc to the shift register/data register section 141 as the correction data on the basis of a comparison determination result output from the voltage comparison section 145.

For example, a counter may be provided in the offset voltage generation section 143. In this case, the offset setting value (variable) Minc is set by modulating (e.g., increasing) the count value of the counter on the basis of the comparison determination result. The counter to be used in the setting operation is configured to operate at a predetermined clock frequency CK and to increase the count value by one every time a signal corresponding to a predetermined voltage value fetched at the timing of the clock frequency CK. Alternatively, the system controller 150 or the like may supply the setting value as the offset setting value (variable) Minc that has been appropriately modulated to the shift register/data register section 141 on the basis of the comparison determination result.

The unit voltage Vunit can be set to an arbitrary constant voltage value. The lower the absolute value of the unit voltage Vunit, the smaller a voltage difference between the offset voltages Vofst can be. When the voltage difference between the offset voltages Vofst is made smaller, the offset voltage generation section 143 can generate an offset voltage Vofst more approximate to the change amount of the threshold voltage of the transistor Tr13 provided for each display pixel PIX (pixel drive circuit DC) in the writing operation. Consequently, the voltage adjustment section 144 can compensate a gradation signal more finely and more correctly.

As a voltage value set as the unit voltage Vunit, it is possible to apply a voltage difference between drain-source voltages Vds at adjacent gradations obtained in the voltage-current characteristics (e.g., operating characteristic curve shown in FIG. 4A) of a transistor. Such a unit voltage Vunit may be one which is stored in a memory provided in the offset voltage generation section 143 or the data driver 140 or one which is supplied from the system controller 150 or the like, then temporarily stored in a register provided in the data driver 140.

It is preferable to set the unit voltage Vunit to the smallest potential difference among potential differences obtained by subtracting drain-source voltage Vds_k+1 (>Vds_k) (k is an integer, and higher luminance gradation is obtained as k becomes larger) at (k+1)-th gradations in the transistor Tr13 from drain-source voltage Vds_k (positive voltage value) at k-th gradation. Here, it is assumed that an organic EL element OLED whose light emission luminance substantially linearly increases with the density of a current flowing is employed in combination with the TFT transistor Tr13, particularly, an amorphous silicon TFT. In this case, typically, the potential difference between adjacent gradations tends to become small as the gradation becomes higher. That is, the higher the drain-source voltage Vds, or the larger the amount of the drain-source current Ids is, the smaller the potential difference between adjacent gradations becomes. For example, in the case where voltage gradation control of 256 gradations is performed, (0-th gradation is non-light emitting state), the potential difference between a voltage Vds at the highest luminance gradation (e.g., 255-th gradation) and voltage Vds at 254-th gradation ranks as the smallest potential difference at adjacent gradations. In this case, it is preferable that the unit voltage Vunit be set to a value obtained by subtracting the drain-source voltage Vds at the highest gradation (or gradation in the vicinity of the highest luminance gradation) from the drain-source voltage Vds at a luminance gradation one level below the highest luminance gradation (or gradation in the vicinity of the highest luminance gradation).

The voltage adjustment section 144 adds the original gradation voltage Vorg output from the gradation voltage generation section 142 and offset voltage Vofst output from the offset voltage generation section 143 and outputs the resultant voltage to data lines Ld arranged in a column direction on the display panel 110 through the voltage comparison section 145. Specifically, in the correction data acquisition operation, the voltage adjustment section 144 adds, in an analog fashion, an offset voltage Vofst which is generated on the basis of an offset setting value optimized by the appropriate modulation to an original gradation voltage Vorg_x corresponding to a predetermined gradation (x-th gradation) which is output from the gradation voltage generation section 142. Then, the voltage adjustment section 144 outputs a resultant voltage component corresponding to the sum of the above voltages to the voltage comparison section 145 as an adjustment voltage Vadj.

In the writing operation, the correction gradation voltage Vpix satisfies the following expression (12).

$$Vpix=Vorg+Vofst \tag{12}$$

That is, the voltage adjustment section 144 receives the original gradation voltage Vorg corresponding to display data from the gradation voltage generation section 142 and offset voltage Vofst which is generated by the offset voltage generation section 143 on the basis of the correction data fetched from the frame memory 146. The voltage adjustment section 144 adds, in an analog fashion (in the case where the gradation voltage generation section 142 has a D/A converter) or digital fashion, the offset voltage Vofst to original gradation voltage Vorg. Then, the voltage adjustment section 144 outputs a resultant voltage component corresponding to the sum of the above voltages to each data line Ld as a compensating gradation voltage Vpix at the time of the writing operation.

As shown in FIG. 10, the voltage comparison section 145 includes a comparator 147, a constant current source 148, and a connection path switch 149. The connection path switch 149 is a switch for swichingly connecting the data line Ld to either the constant current source 148 or voltage adjustment section 144. The comparator 147 has one input terminal connected to the constant current source 148 and the other input terminal connected to the output terminal of the voltage adjustment section 144.

Here, assumed is a case where a predetermined voltage is applied (it is preferable, in particular, that the power supply voltage Vccw be applied) to the power supply voltage line Lv. In this case, the voltage comparison section 145 forcibly draws a reference current Iref_x (e.g., a current value required for the organic EL device OLED to emit light at the highest luminance gradation) having a predetermined current value at a previously set predetermined gradation x (e.g., highest luminance gradation) from the data line Ld to data driver 140 using the constant current source 148. At this time, the constant current source 148 outputs a measurement potential (reference voltage) Vref_x on the data line Ld (or constant current source 148) at the predetermined gradation x to one input terminal of the comparator 147. Subsequently, an adjustment current Vadj output from the voltage adjustment section 144 is input to the other input terminal of the comparator 147 in a state where the voltage of the power supply voltage line Lv is maintained at the predetermined voltage (power supply voltage Vccw).

The comparator 147 compares the measurement potential Vref_x which is a potential output from the constant current source 148 and adjustment voltage Vadj which is a potential generated by the voltage adjustment section 144. When the adjustment voltage Vadj is higher than the measurement potential Vref_x, the comparator 147 outputs a positive voltage signal Vp to the counter provided in the offset voltage generation section 143 so as to increase the counter value of the counter by one. That is, when the potential difference (Vccw−Vadj) between the power supply voltage line Lv and data line Ld obtained in the case where the adjustment voltage Vadj is applied to the data line Ld is lower than potential difference (Vccw−Vref_x) between the power supply voltage line Lv and data line Ld obtained in the case where the reference current Iref_x at x gradation is forcibly supplied to the data line Ld, the comparator 147 outputs the positive voltage signal Vp to the counter provided in the offset voltage generation section 143.

On the other hand, when the adjustment voltage Vadj is lower than the measurement potential Vref_x, the comparator 147 outputs a negative voltage signal Vn to the counter provided in the offset voltage generation section 143. This negative voltage signal Vn does not increase the counter value of the counter. That is, when the potential difference (Vccw−Vadj) between the power supply voltage line Lv and data line Ld obtained in the case where the adjustment voltage Vadj is applied to the data line Ld is higher than potential difference (Vccw−Vref_x) between the power supply voltage line Lv and data line Ld obtained in the case where the reference current Iref_x at x gradation is forcibly supplied to the data line Ld, the comparator 147 outputs the negative voltage signal Vn to the counter provided in the offset voltage generation section 143.

In the writing operation, the connection path switch 149 disconnects the data line Ld from the constant current source 148 and connects the voltage adjustment section 144 and data line Ld. Then, the correction gradation voltage Vpix generated by the voltage adjustment section 144 is applied to each display pixel PIX through the data line Ld. In this case, however, the drawing of the reference current or comparison with the reference voltage is not performed.

The frame memory 146 executes the correction data acquisition operation before the writing operation of display data (correction gradation voltage Vpix) for each display pixel PIX arranged on the display panel 110. In this correction data acquisition operation, the frame memory 146 sequentially fetches offset setting values Minc of the display pixels PIX of one row which are set by the offset voltage generation section 143 provided for each column as correction data through the shift register/data register section 141. Then the frame memory 146 stores the correction data of each display pixel PIX corresponding to one screen (one frame) of the display panel in an individual storage area. Further, in the writing operation, the frame memory 146 sequentially outputs the correction data of the display pixels PIX of each row to the offset voltage generation section 143 through the shift register/data register section 141.

(System Controller)

As shown in FIG. 9, the system controller 150 generates and outputs the selection control signal, power supply control signal, and data control signal for controlling the operating state with respect to the selection driver 120, power supply driver 130 and data driver 140 to allow the respective driver to operate at a predetermined timing. Consequently, the selection signal Ssel having a predetermined voltage level, power supply voltage Vcc, adjustment voltage Vadj, and compensating gradation voltage Vpix are generated and output from the respective drivers. Further, the system controller 150 outputs the data control signal to the display panel to allow a series of drive control operations (correction data acquisition operation, writing operation, holding operation, and light-emitting operation) to be performed, thereby allowing the display panel 110 to display predetermined image information corresponding to an image signal.

(Display Signal Generation Circuit)

The display signal generation circuit 160 extracts a luminance gradation signal component from an image signal supplied, for example, from the outside of the display apparatus 100, and supplies for each one row of the display panel 110 the luminance gradation signal component as display data (luminance gradation data) including digital signals to the data driver 140. Here, in the case where the image signal includes a timing signal component for regulating the display timing of the image data like a television broadcast signal (a composite image signal), the display signal generation circuit 160 may have a function of extracting a timing signal component and supplying the component to the system controller 150 in addition to a function of extracting the luminance gradation signal component. In this case, the system controller 150 generates control signals which are respectively supplied to the selection driver 120, power supply driver 130 and data driver 140 on the basis of the timing signal supplied from the display signal generation circuit 160.

<Driving Method of Display Apparatus>

Next, a driving method in the display apparatus according to the present embodiment will be described with reference to FIGS. 11 to 13.

The drive control operation of the display apparatus 100 according to the present embodiment roughly includes correction data acquisition operation and display drive operation. In the correction data acquisition operation, the display apparatus 100 detects an offset voltage Vofst (or more strictly, the adjustment voltage Vadj) corresponding to a change in the device characteristics (threshold voltage) of the transistor Tr13 (driving transistor) for light-emission drive which is provided for each display pixel PIX (pixel drive circuit DC) arranged on the display panel 110. Then, the display apparatus 100 stores an offset setting value (specified value) for generating the detected offset voltage Vofst in the frame memory 146 as correction data for each display pixel PIX. Subsequently, in the display drive operation, the display apparatus 100 compensates an original gradation voltage Vorg corresponding to display data on the basis of the correction data acquired for each display pixel PIX and writes the compensated original gradation voltage Vorg in each display pixel PIX as correction gradation voltage Vpix and stores it as a voltage component. Then, the display apparatus 100 supplies a light-emission drive current Iem having a current value corresponding to display data, which has been obtained by compensating the influence of a change in the device characteristics of the transistor Tr13 on the basis of the stored voltage component, to the organic EL device OLED to allow it to emit light at a predetermined luminance gradation. The above correction data acquisition operation and display drive operation are executed on the basis of the various control signals supplied from the system controller 150.

Hereinafter, the respective operations will concretely be described.

(Correction Data Acquisition Operation)

Figure 11:
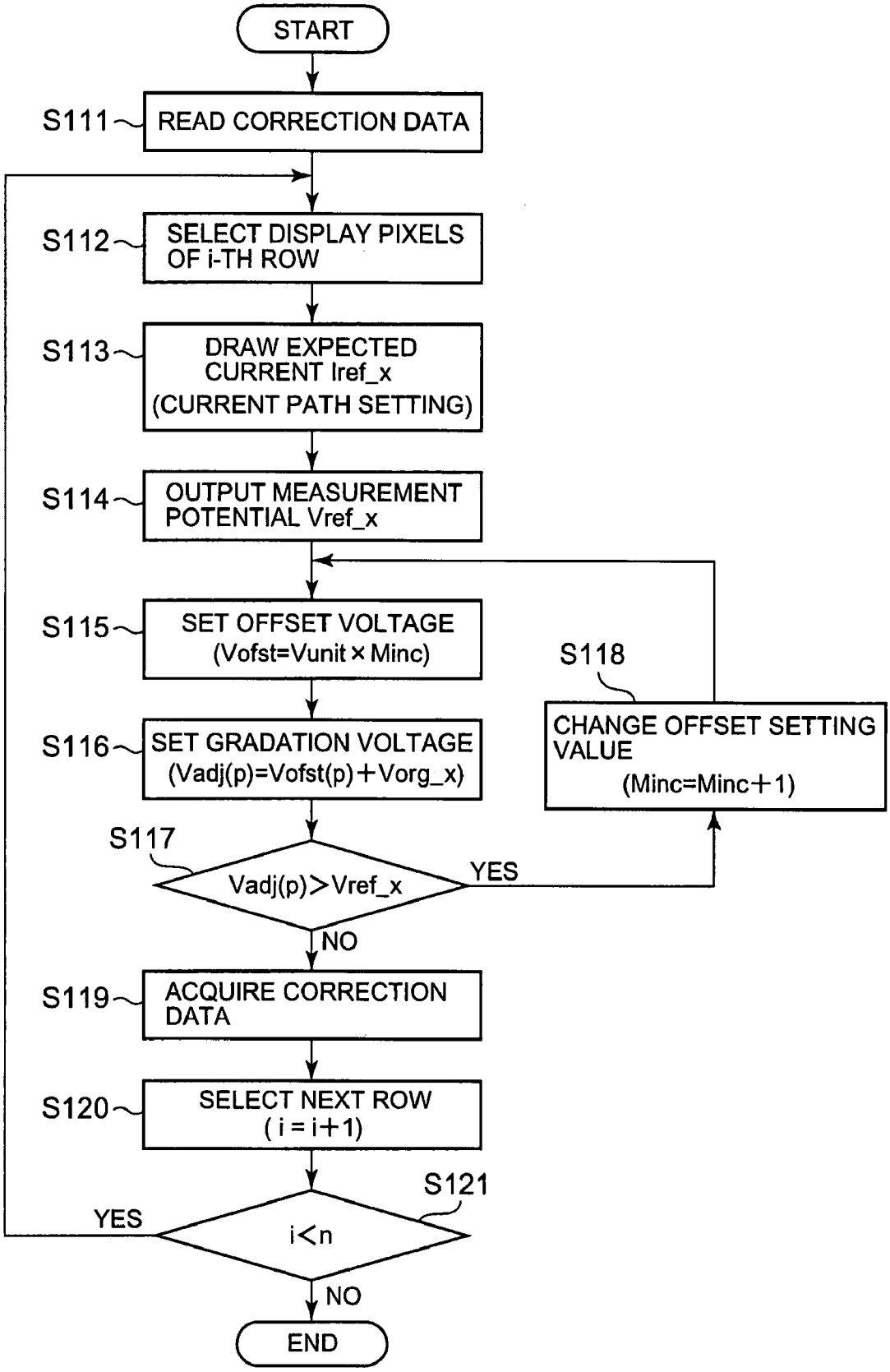
FIG. 11 is a flowchart showing an example of correction data acquisition operation performed in a display apparatus according to the present embodiment.

FIG. 11 is a flowchart showing an example of the correction data acquisition operation performed in the display apparatus according to the present embodiment. FIG. 12 is a conceptual view showing the correction data acquisition operation (reference current drawing operation) performed in the display apparatus according to the present embodiment. FIG. 13 is a view showing operation for measuring a measurement potential Vref_x and operation for transferring, as correction data, an offset setting value Minc of the set offset voltage Vofst to the frame memory 146, which are performed in correction data acquisition operation of the display apparatus according to the present embodiment.

In the correction data acquisition operation (offset voltage detection operation: first step) according to the present embodiment, as shown in FIG. 11, the display apparatus 100 allows the offset voltage generation section 143 to read the offset setting value Minc (Minc is initially set to 0) corresponding to the display pixels PIX of i-th row (i is a positive integer satisfying $1 \leqq i \leqq n$) from the frame memory 146 through the shift register/data register section 141 (step S1). Subsequently, as in the case of the abovementioned writing operation of the pixel circuit section DCx, the display apparatus 100 applies a low potential power supply voltage (first power supply voltage) Vcc (=Vccw≦reference voltage Vss) having a voltage corresponding to a writing operation level to the power supply voltage line Lv connected to all of the display pixels PIX of i-th row (i is a positive integer satisfying $1 \leqq i \leqq n$) (in the present embodiment, the power supply voltage line Lv is connected in common to all the display pixels PIX belonging to a group including the i-th row) from the power supply driver 130. In this state, the display apparatus 100 applies a selection level (high-level) selection signal Ssel from the selection driver 120 to the selection line Ls of i-th row to thereby set the display pixels PIX of i-th row in a selection state (step S112).

As a result, the transistor Tr11 provided for each pixel drive circuit DC of the display pixel PIX of i-th row is turned ON to set the transistor Tr13 (driving transistor) in a diode connection state. Then, the power supply voltage Vcc (=Vccw) is applied to the drain terminal and gate terminal (node N11: one end side of the capacitor Cs) of the transistor Tr13. Further, the transistor Tr12 is also turned ON to electrically connect the source terminal (node N12; other end side of the capacitor Cs) to the data line Ld to allow a reference current Iref_x to flow in the data line Ld.

Figure 12:
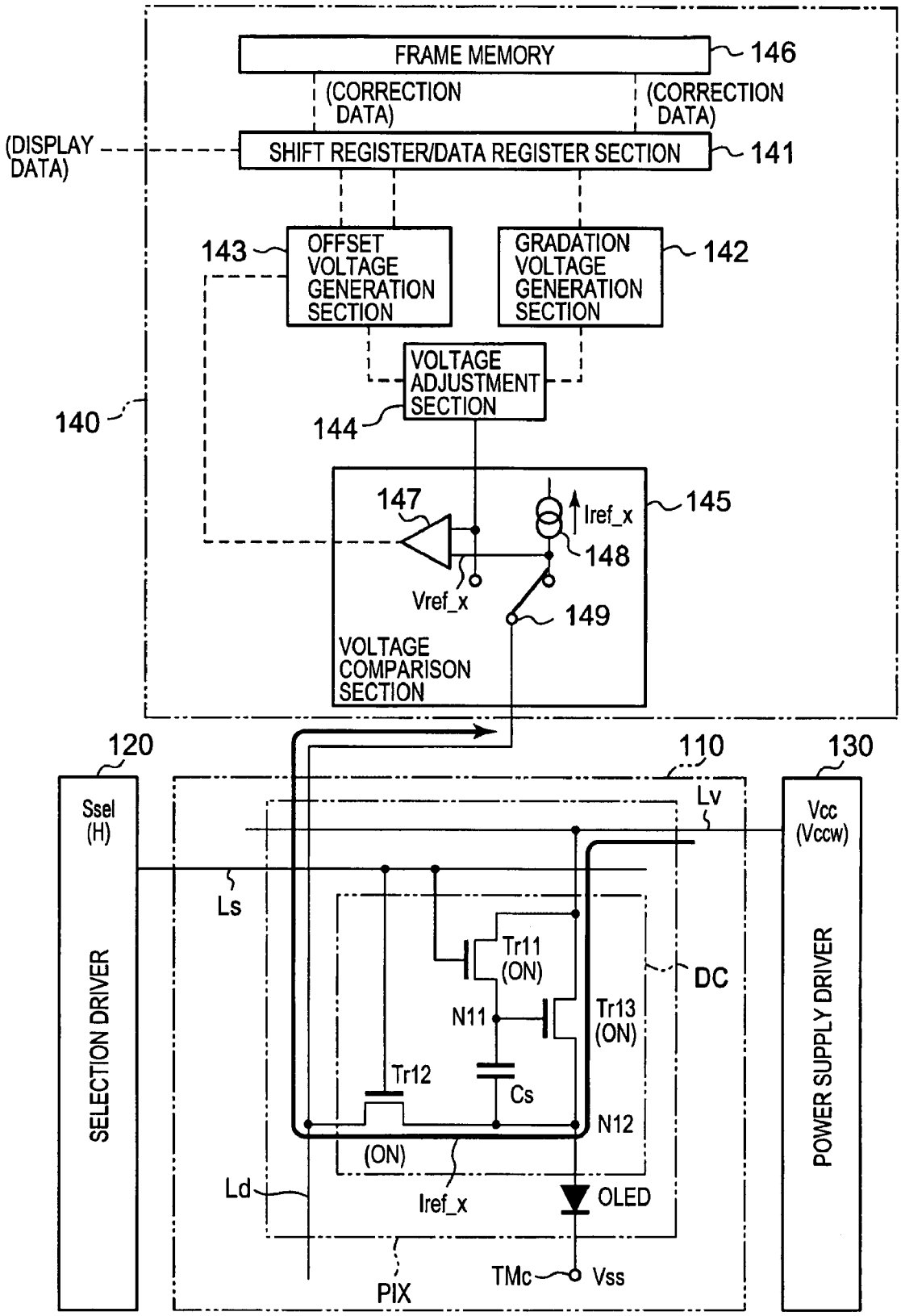
FIG. 12 is a conceptual view showing correction data acquisition operation (reference current drawing operation) performed in a display apparatus according to the present embodiment.
Figure 13:
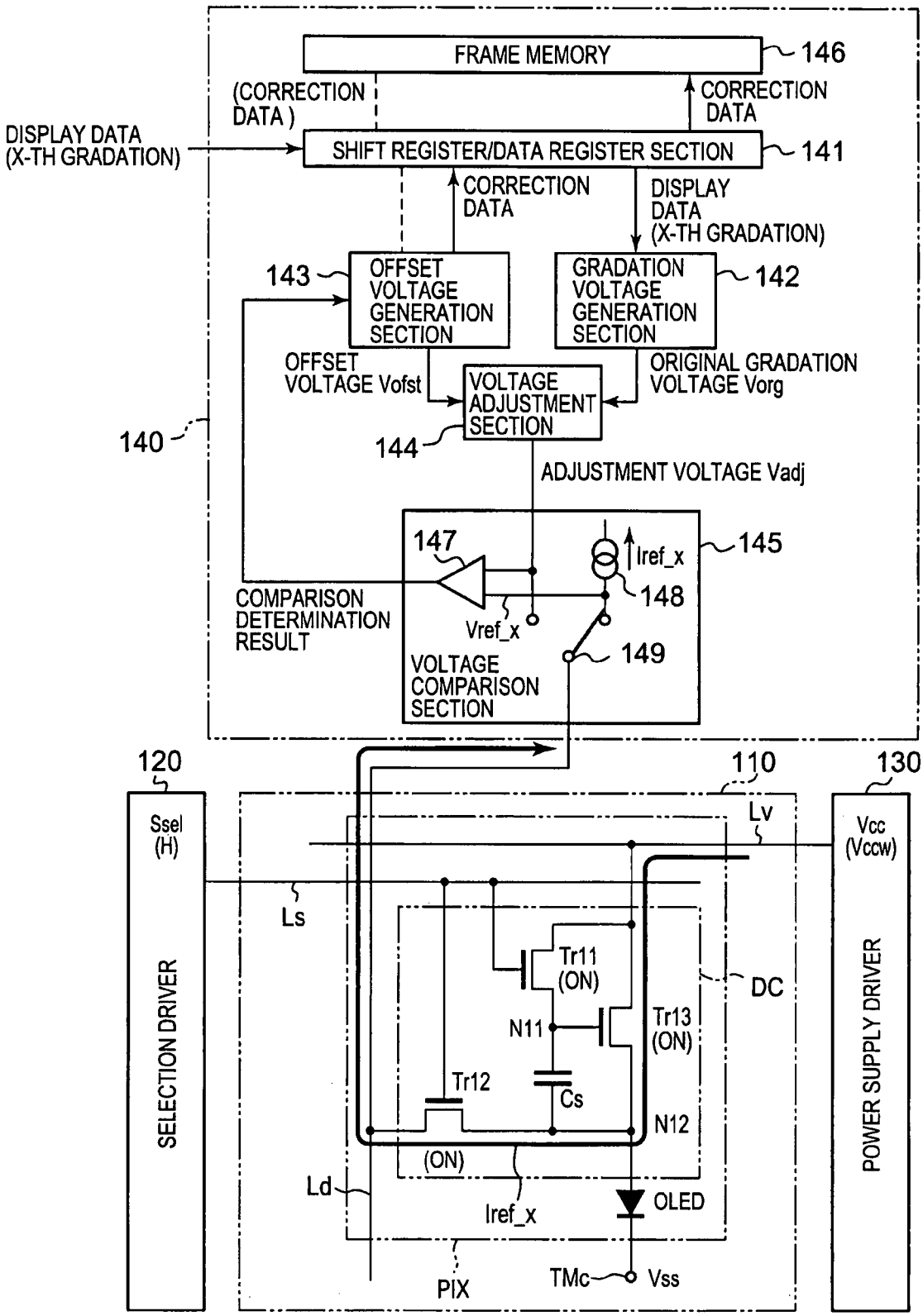
FIG. 13 is a view showing operation for measuring a measurement potential Vref_x and operation for transferring set correction data to a frame memory 146 which are performed in correction data acquisition operation of a display apparatus according to the present embodiment.

Subsequently, as shown in FIG. 12, in each voltage comparison section 145, the connection path switch 149 connects the data line Ld to the constant current source 148. The display apparatus 100 forcibly draws the reference current Iref_x from the data line Ld side toward the data driver 140. The reference current Iref_x is set such that a voltage for writing the display data having a predetermined gradation (e.g., x-th gradation) in the display pixel PIX corresponds (or substantially corresponds) to a target EL drive current (expected current value) (step S113).

Therefore, the current value of the drain-source current Ids_x of the transistor Tr13 at this time corresponds to the current value of the reference current Iref_x irrespective of whether both of the transistors Tr12 and Tr13 assume the V-I characteristic curve SPw (FIG. 4A) in the initial state or V-I characteristic curve SPw2 (FIG. 4) after the shift of the threshold voltage Vth. Further, it is preferable, at this time, that the reference current Iref_x be brought to a target current value at high-speed and have a higher current value at the highest luminance gradation or at a luminance gradation in the vicinity of the highest luminance gradation.

Then, in this state, the display apparatus 100 outputs the measurement potential (reference potential) Vref_x on the data line Ld (or constant current source 148) to one input terminal of the comparator 147 (step S114). The step S111 of reading out the offset setting value Minc to the offset voltage generation section 143 may be performed after any of the steps S112 to S114. The measurement potential Vref_x changes as the resistances of the transistors Tr12 and Tr13 in which the reference current Iref_x flows between the drain and source thereof become higher.

In particular, the measurement potential Vref_x is influenced by the degree of the progression of the V-I characteristic curve SPw2 in which the threshold voltage Vth (FIG. 4A) at the gate-source (or drain-source) voltage Vgs of the diode-connected transistor Tr13 has been shifted and degree of the progression of the V-I characteristic curve SPw2 in which the threshold voltage Vth at the gate-source voltage Vgs of the transistor Tr12 has been shifted. In other words, as the shift of the threshold voltages Vth of the transistors Tr13 and Tr12 has progressed (i.e., ΔV becomes larger), the measurement potential Vref_x becomes lower. The measurement potential Vref_x that has been obtained may temporarily be stored in, e.g., a register or the like provided in the voltage comparison section 145.

Subsequently, the display apparatus 100 sets the offset voltage Vofst on the basis of the offset setting value Minc input to the offset voltage generation section 143 as shown by the above expression (1) (step S115). The offset voltage Vofst generated in the offset voltage generation section 143 is calculated by multiplying the unit voltage Vunit by the offset setting value Minc (Vofst=Vunit×Minc). Therefore, in the case where the shift of the threshold value has not taken place in the initial stage, the offset setting value Minc output from the frame memory 146 is 0, so that the initial value of the offset voltage Vofst is 0V.

The voltage adjustment section 144 adds the offset voltage Vofst output from the offset voltage generation section 143 and original gradation voltage Vorg_x corresponding to the predetermined gradation (x-th gradation) output from the gradation voltage generation section 142 as shown by the following expression (13) to thereby generate an adjustment voltage Vadj(p) (step S116).

$$Vadj(p)=Vofst(p)+Vorg_x \tag{13}$$

where "p" of Vadj(p) and Vofst(p) represents a number of times of offset setting operations in the correction data acquisition operation and is a natural number. The value of p sequentially increases with a change of the offset setting value (which will be described later). Therefore, Vofst(p) is a variable having a negative value whose absolute value increases with the increase of value of p, and Vadj(p) is a variable having a negative value whose absolute value increases in accordance with the value Vofst(p), that is, increases with the increase of value of p.

The voltage comparison section 145 determines whether the potential of the obtained adjustment voltage Vadj(p) is higher than the potential of the measurement potential Vref_x obtained in step S114 using the comparator 147 (step S117).

Assume that the adjustment voltage Vadj(p) is higher than the measurement potential Vref_x (YES in step S17). In this case, when the adjustment voltage Vadj(p) is applied without modification to the data line Ld as the correction gradation voltage Vpix at the time of writing operation, there is a possibility that it is impossible to flow a current corresponding to a gradation that is originally intended to be displayed between the drain and source of the transistor Tr13 due to influence of the shifts of the threshold values between the V-I characteristic curves SPw and SPw2 of the transistors Tr12 and Tr13. As a result, a current corresponding to a gradation lower than the originally desired one may flow between the drain and source of the transistor Tr13 in some cases.

Thus, in the case where the adjustment voltage Vadj(p) is higher than the measurement potential Vref_x, the comparator 147 outputs a positive voltage signal Vp to the counter provided in the offset voltage generation section 143 so as to increase the counter value of the counter by one.

When the counter of the offset voltage generation section 143 increases its count value by one, the offset voltage generation section 143 adds one to the value of the offset setting value Minc (step S118) and executes step S115 once again using the offset setting value Minc to which one has been added to thereby generate Vofst(p+1). Therefore, Vofst(p+1) is a negative value that satisfies the following expression (14).

$$Vofst(p+1)=Vofst(p)+V\text{unit} \quad (14)$$

Thereafter, steps S115 to S118 are repeated, following step S116 and subsequent steps, until the adjustment voltage Vadj (p) falls below the measurement potential Vref_x in step S117.

When the adjustment voltage Vadj(p) is lower than the measurement potential Vref_x (NO in step S17), the comparator 147 outputs a negative voltage signal Vn that does not increase the value of the counter of the offset voltage generation section 143 thereto. When the negative voltage signal Vn is applied to the counter that fetches a positive voltage signal Vp or a negative voltage signal Vn at a predetermined frequency, the offset voltage generation section 143 determines that the adjustment voltage Vadj(p) has compensated the potential corresponding to the shifts of the threshold values between the V-I characteristic curves SPw and SPw2 of the transistors Tr12 and Tr13. The offset voltage generation section 143 outputs the gradation offset setting value Minc at that time, as the correction data, to the shift register/data register section 141 so as to adopts the adjustment voltage Vadj(p) at that time as the correction gradation voltage Vpix being applied to the data line Ld. The shift register/data register section 141 transfers the gradation offset setting value Minc serving as the correction data for each column to the frame memory 146, whereby the correction data acquisition operation is completed (step S119).

The frame memory 146 outputs the accumulated gradation offset setting value Minc to the offset voltage generation section 143 both in the correction data acquisition operation and writing operation.

After acquiring the correction data for the display pixels PIX of i-th row, the display apparatus 100 executes a series of the abovementioned operations for the display pixels PIX of the next row ((i+1)-th row). For this purpose, the display apparatus 100 increments the variable "i" for specifying a row (i=i+1) (step S120).

Then, the display apparatus 100 determines whether the variable "i" that has been incremented is smaller (i<n) than the total row-number n set on the display panel 110 (step S121).

When it is determined in step 121 that the variable "i" is smaller than the total row-number n (i<n), the abovementioned steps S112 to S121 are executed again. The same processing is repeated until it is determined in step S121 that the variable "i" corresponds to the total row-number (i=n).

When it is determined in step S121 that the variable "i" corresponds to the total row-number (i=n), the correction data acquisition operation for the display pixel PIX of each row is executed for all the rows on the display panel 110. Then, the correction data for each display pixel PIX is individually stored in a predetermined storage area in the frame memory 146, and a series of the abovementioned correction data acquisition operation is completed.

During the correction data acquisition operation, the potentials of the respective terminals satisfy the abovementioned expressions (3) to (10), so that a current does not flow in the organic EL device OLED, with the result that the organic EL device OLED does not emit light.

As described above, in the correction data acquisition operation, the display apparatus 100 connects the constant current source 148 to data line Ld to measure the measurement potential Vref_x as shown in FIG. 12. Then, as shown in FIG. 13, in the case where the drain-source current Ids_x of the transistor Tr13 at x-th gradation which has been obtained according to the V-I characteristic curve SPw is set to the expected value, the display apparatus 100 sets, in the writing operation, the offset voltage Vofst for supplying the drain-source current Ids of the transistor Tr13 approximated to the expected value. The display apparatus 100 stores the gradation offset setting value Minc at this offset voltage Vofst in the frame memory 146 as the compensation data.

That is, as shown in the expression (13), the voltage adjustment section 144 adds the negative potential offset voltage Vofst(p) being in accord with the gradation offset setting value Minc sent from the offset voltage generation section 143 and negative potential original gradation voltage Vorg_corresponding to x-th gradation sent from the gradation voltage generation section 142 to thereby generate an adjustment voltage Vadj(p). When the adjustment voltage Vadj(p) is corrected to be approximated to the drain-source current Ids_x which is the expected value of the transistor Tr13 at the time of writing operation, the display apparatus 100 stores the gradation offset setting value Minc at the adjustment voltage Vadj(p) in the frame memory 146. The potential of the adjustment voltage Vadj(p) is applied to the data line Ld as the correction gradation voltage Vpix in the display drive operation.

In the above example, the gradation voltage generation section 142 generates the original gradation voltage Vorg_x on the basis of display data for each display pixel PIX supplied from the display signal generation circuit 160. Alternatively, however, the original gradation voltage Vorg_x for adjustment may be set to a fixed value. In this case, the gradation voltage generation section 142 outputs the original gradation voltage Vorg_x without supply of the display data from the display signal generation circuit 160. It is preferable, as described above, that the original gradation voltage Vorg_x at this time have a potential at which the reference current Iref_x allows the organic EL device OLED to emit light at highest luminance gradation (or luminance gradation in the vicinity of the highest luminance gradation) at the time of the light-emitting operation.

Further, in the above embodiment, since the display apparatus 100 is a current-drawing type one in which the drain-source current Ids of the transistor Tr13 flows from the display transistor Tr13 to the data driver 140, the unit voltage Vunit is set as a negative value. However, in the case of a current-pushing type display apparatus in which the drain-source current Ids of the transistor flows from the data driver 140 to the transistor connected in series to the organic EL element OLED, the unit voltage Vunit may be set to a positive value.

(Display Drive Operation)

The display drive operation in the display apparatus according to the present embodiment will next be described with reference to FIGS. 15 to 18.

Figure 14:
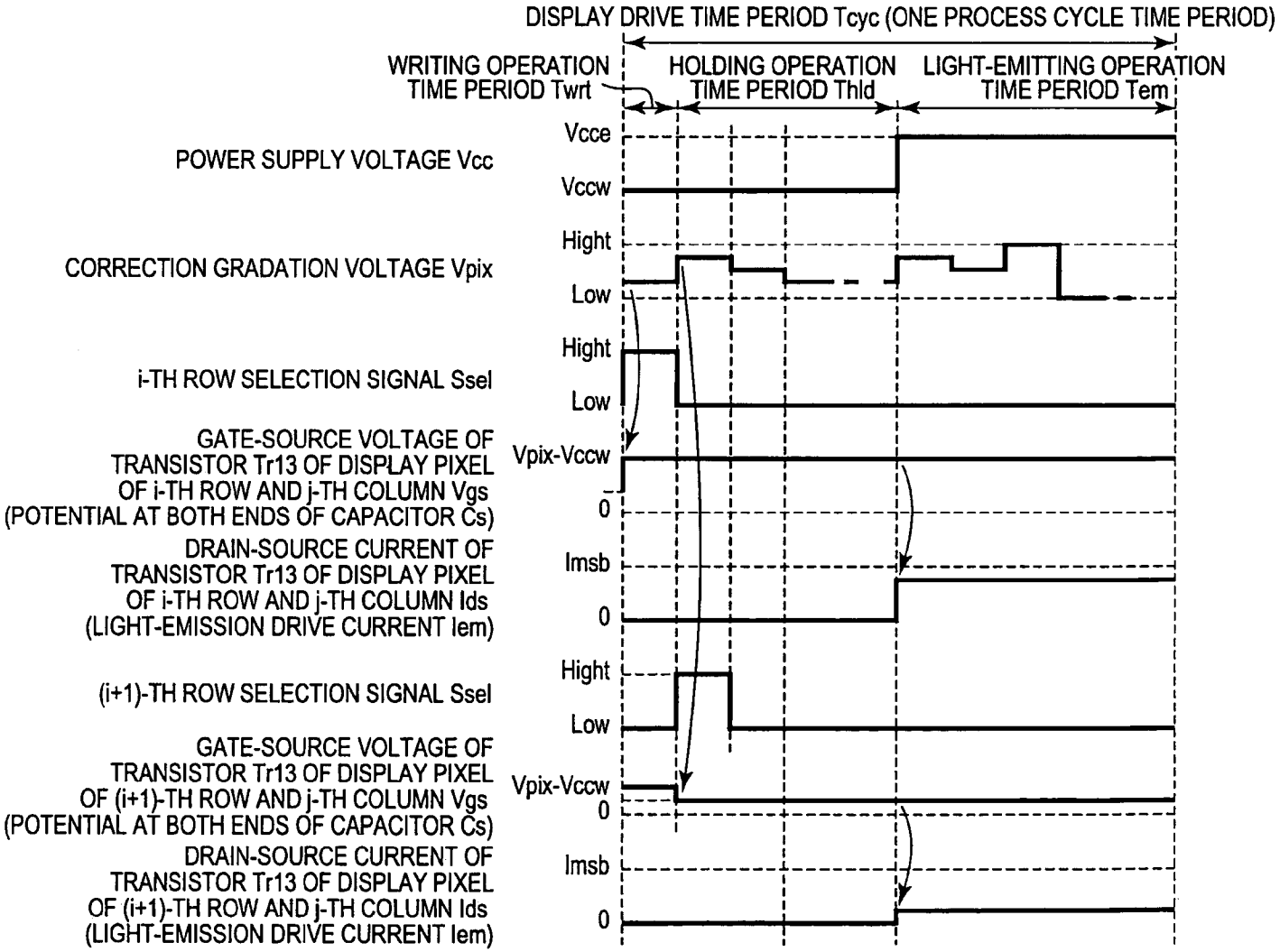
FIG. 14 is a timing chart showing an example of display drive operation performed in a display apparatus according to the present embodiment.
Figure 15:
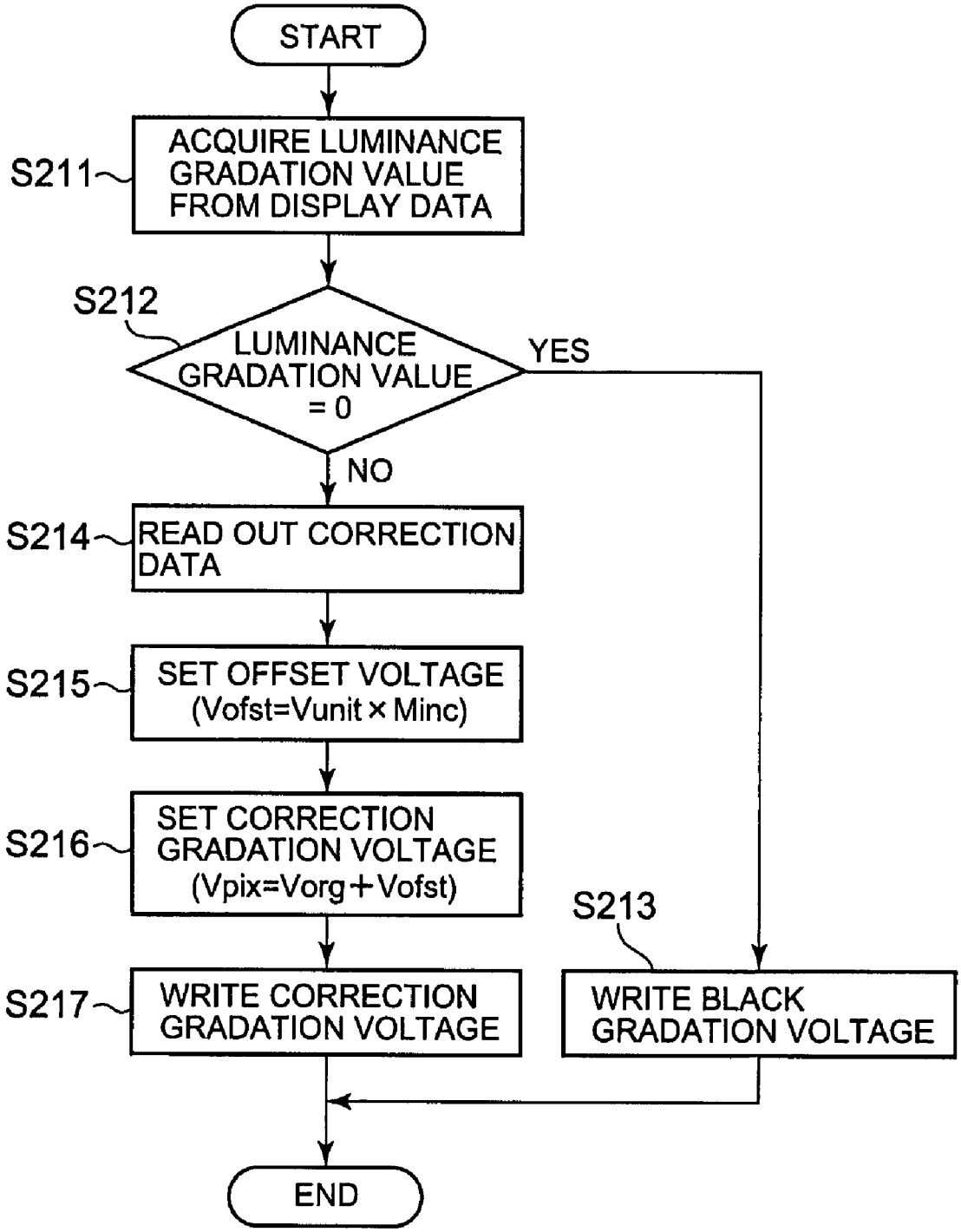
FIG. 15 is a flowchart showing an example of writing operation performed in a display apparatus according to the present embodiment.
Figure 16:
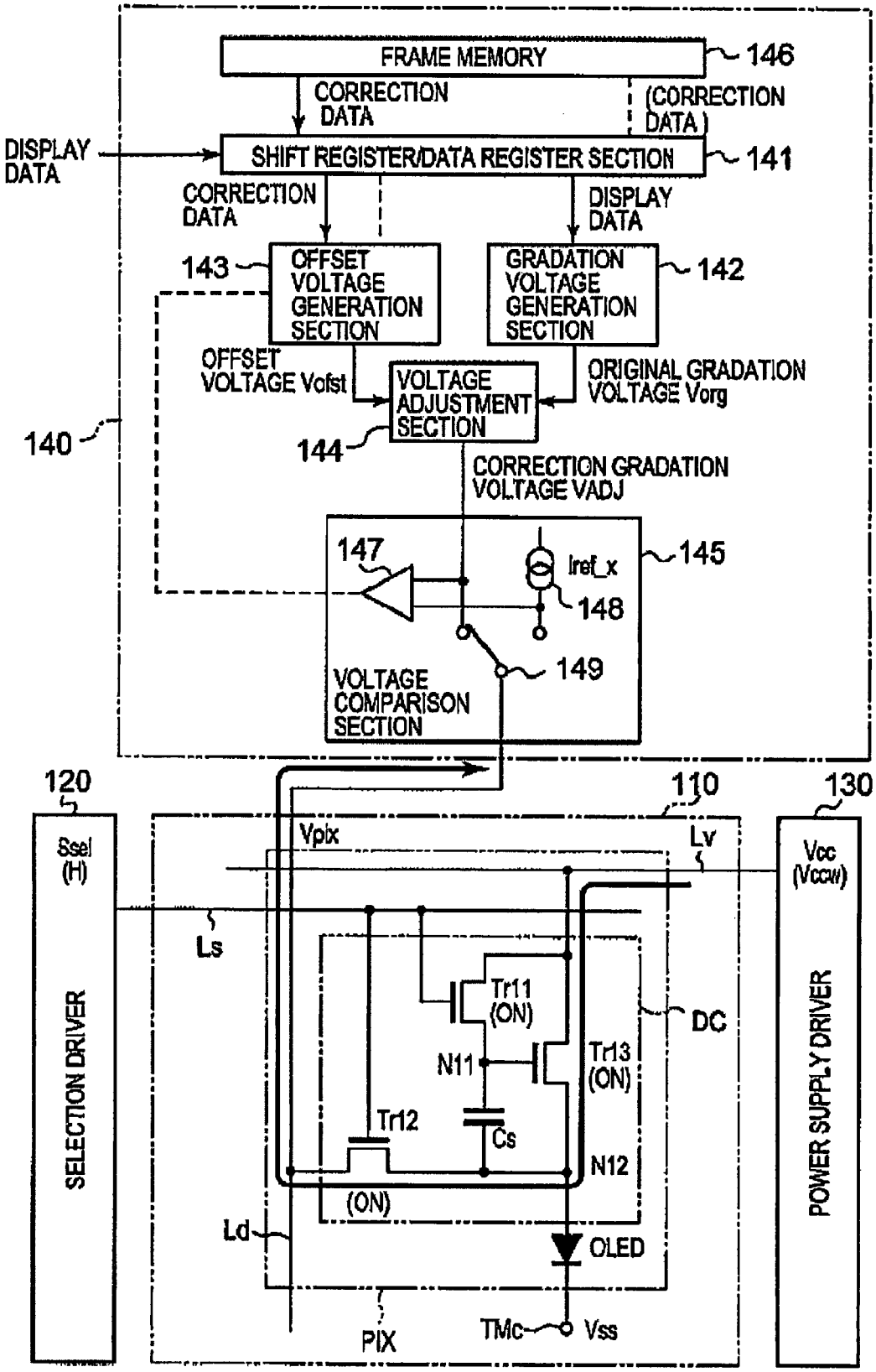
FIG. 16 is a conceptual view showing writing operation performed in a display apparatus according to the present embodiment.
Figure 17:
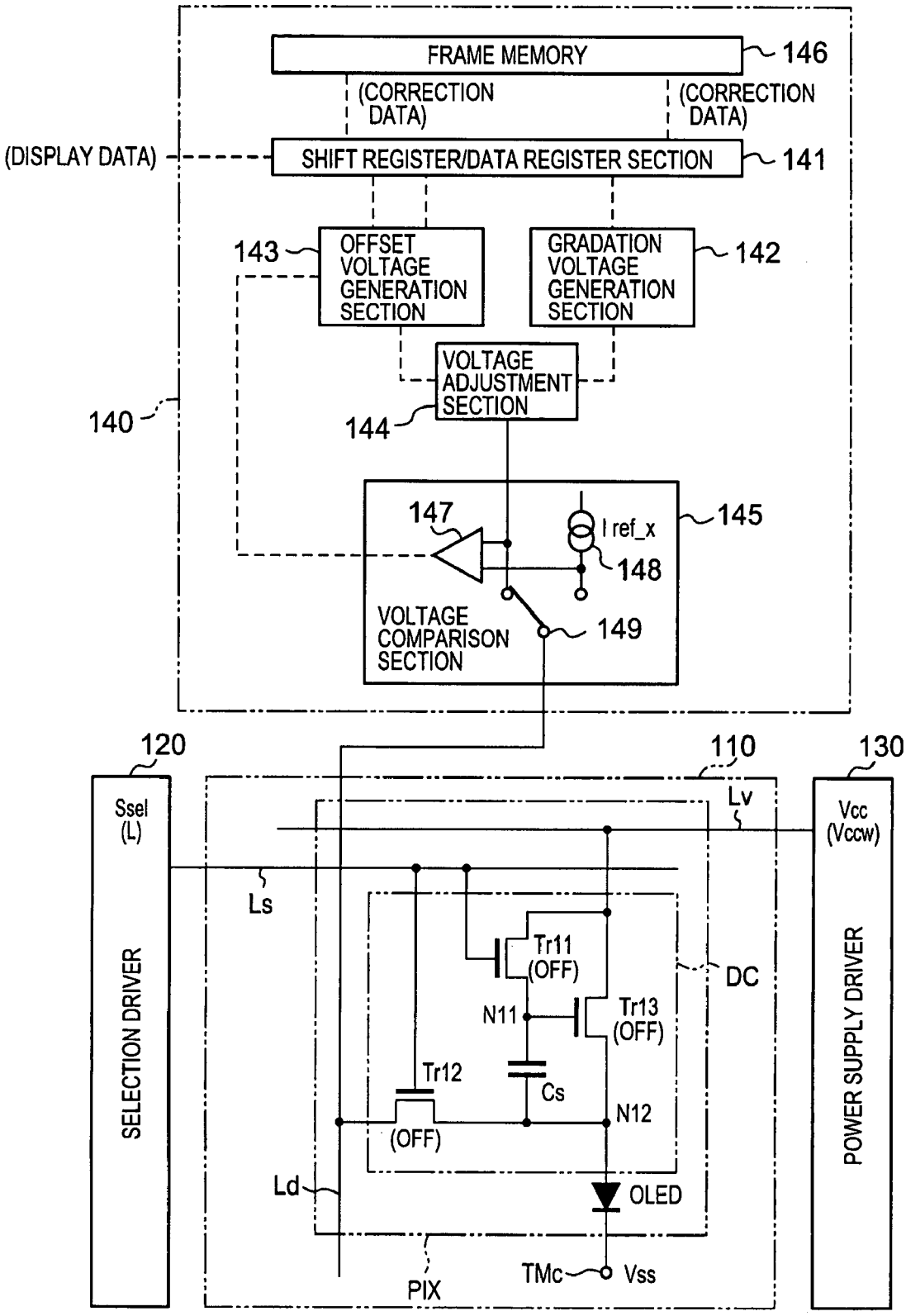
FIG. 17 is a conceptual view showing holding operation performed in a display apparatus according to the present embodiment.
Figure 18:
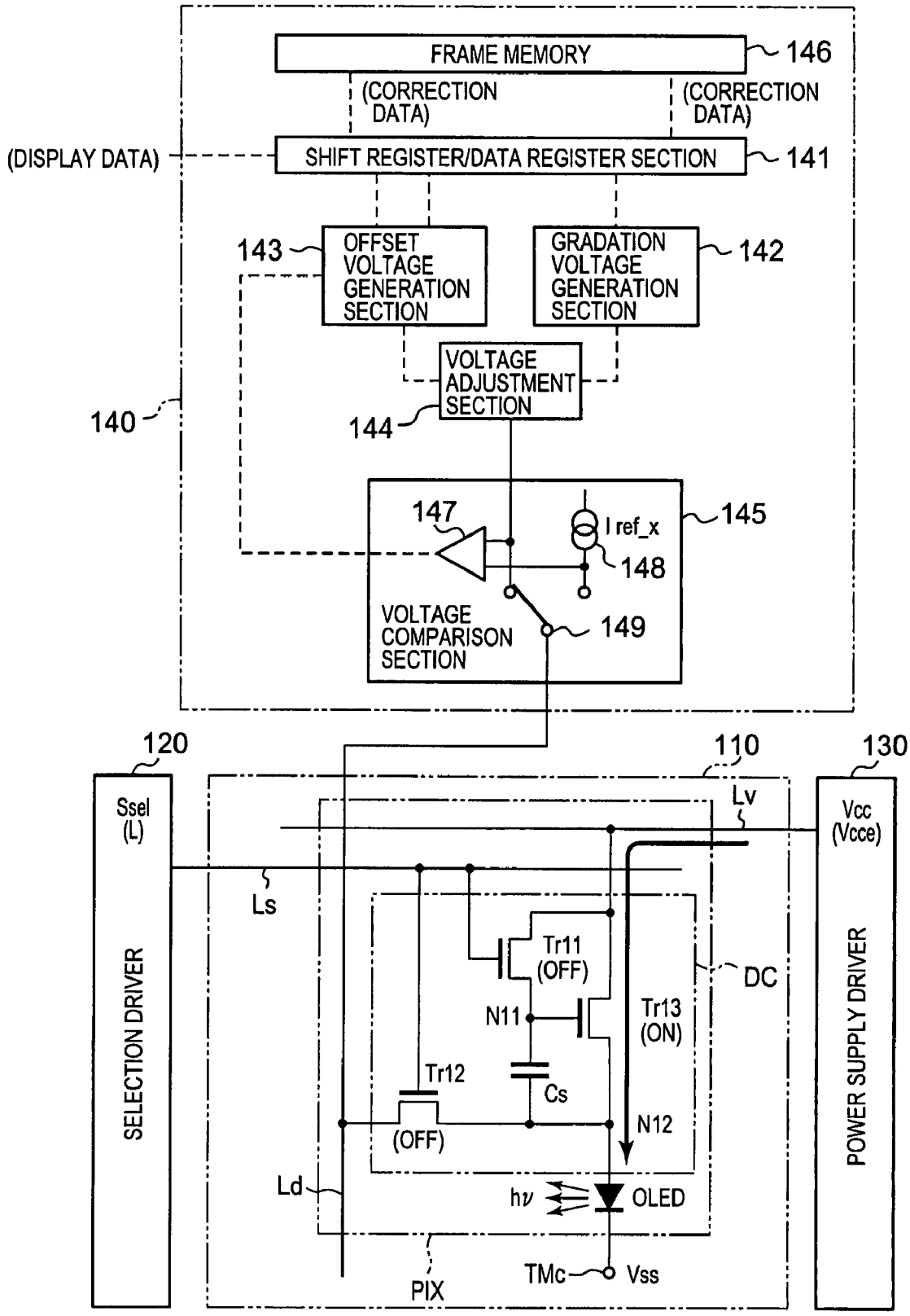
FIG. 18 is a conceptual view showing light emitting operation performed in a display apparatus according to the present embodiment.

FIG. 14 is a timing chart showing an example of the display drive operation performed in the display apparatus according to the present embodiment. In this timing chart, a case where, among all the display pixels PIX arranged in a matrix form on the display panel 110, the display pixels PIX of i-th row and j-th column and (i+1)-th row and j-th column (i is a positive integer satisfying $1 \leqq i \leqq n$, j is a positive integer satisfying $1 \leqq j \leqq m$) are allowed to emit light at a luminance gradation corresponding to display data will be described for descriptive purposes. FIG. 15 is a flowchart showing an example of the writing operation performed in the display apparatus according to the present embodiment. FIG. 16 is a conceptual view showing the writing operation performed in the display apparatus according to the present embodiment. FIG. 17 is a conceptual view showing the holding operation performed in the display apparatus according to the present embodiment. FIG. 18 is a conceptual view showing the light emitting operation performed in the display apparatus according to the present embodiment.

The display drive operation in the display apparatus 100 according to the present embodiment is set, for example, as shown in FIG. 14, to execute at least the writing operation (writing operation time period Twrt), the holding operation (holding operation time period Thld), and the light-emitting operation (light-emitting operation time period Tem) within a predetermined display drive period (one process cycle period) Tcyc ($Tcyc \geqq Twrt+Thld+Tem$), as in the case of the control method of the abovementioned pixel circuit section DCx (see FIG. 2). In the writing operation, the display apparatus 100 adds, the offset voltage Vofst which is generated with the correction data stored in the frame memory 146 set as the offset setting value Minc, to the original gradation voltage Vorg to thereby generate the correction gradation voltage Vpix. The original gradation voltage Vorg is a voltage corresponding to the display data for each display pixel PIX supplied from the display signal generation circuit 160. The display apparatus 100 supplies the correction gradation voltage Vpix to each display pixel PIX through each data line Ld. In the holding operation, the display apparatus 100 charges the capacitor Cs with a voltage component corresponding to the correction gradation voltage Vpix which is set, by the writing operation, to be written in between the gate and source of the transistor Tr13 provided in the pixel drive circuit DC of the display pixel PIX and holds the voltage component therein. In the light-emitting operation, the display apparatus 100 supplies a light-emission drive current Iem having a current value corresponding to display data to the organic EL device OLED on the basis of the voltage component which is held in the capacitor Cs by the holding operation to allow the organic EL device OLED to emit light at a predetermined luminance gradation.

Here, one process cycle period which is applied to the display drive period Tcyc according to the present embodiment is set to a period which is required for the display pixel PIX to display image data of one pixel out of one frame image. That is, the one process cycle period Tcyc is set to a period which is required for display pixels PIX in one row to display an image of one row out of one frame image in the case where one frame image is displayed on the display panel 110 in which a plurality of display pixels PIX are arranged in a matrix form in a row direction and in a column direction.

(Writing Operation)

In the writing operation (writing operation time period Twrt), as in the case of the writing operation of the pixel circuit section DCx, the display apparatus 100 applies a writing operation level (negative voltage) power supply voltage Vcc ($=Vccw \leqq Vss$) to the power supply voltage line Lv connected to the display pixels PIX of i-th row, as shown in FIG. 15. Then, the display apparatus 100 applies a selection level (high-level) selection signal Ssel to the selection line Ls of i-th row to set the display pixels PIX of i-th row in a selection state. This turns ON the transistors Tr11 (holding transistor) and Tr12 provided in the pixel drive circuit DC. Further, the transistor Tr13 (driving transistor) is set in a diode connection state. The power supply voltage Vcc is applied to the drain and gate terminals of the transistor Tr13 and, at the same time, the source terminal thereof is connected to the data line Ld.

In synchronization with this timing, the correction gradation voltage Vpix corresponding to display data is applied to the data line Ld. The correction gradation voltage Vpix is generated on the basis of a series of the processing operations (gradation voltage correction operation) shown in, e.g., FIG. 15.

More specifically, as shown in FIG. 15, the display apparatus 100 acquires a luminance gradation value of a target display pixel PIX from the display data supplied from the display signal generation circuit 160 (step S211) and determines whether the luminance gradation value is "0" or not (step S212). When the luminance gradation value is "0" in step S212 (YES in step S212), the display apparatus 100 outputs a predetermined gradation voltage (black gradation voltage) Vzero for performing non-light emitting operation (black display operation) from the gradation voltage generation section 142 and directly applies the voltage Vzero to the data line Ld without adding the offset voltage Vofst in the voltage adjustment section 144 (that is, without performing compensation processing for changes in the threshold voltages of the transistors Tr12 and Tr13) (step S213). The gradation voltage Vzero for performing the non-light emitting operation is set to a voltage value ($-Vzero<Vth-Vccw$) having a relationship ($Vgs<Vth$) in which the voltage Vgs ($\approx Vccw-Vzero$) to be applied between the gate and source of the diode-connected transistor Tr13 is lower than the threshold voltage Vth of the transistor Tr13. It is preferable that Vzero be equal to Vccw in order to suppress the shifts of the threshold values of the transistors Tr12 and Tr13.

When the luminance gradation value is not "0" in step S212 (NO in step S212), the display apparatus 100 generates the original gradation voltage Vorg having a voltage value corresponding to the luminance gradation value in the gradation voltage generation section 142 and outputs it (second step). The display apparatus 100 sequentially reads out the correction data that has been acquired by the above correction data acquisition operation and stored in the frame memory 146 in units of display pixel PIX through the shift register/data register section 141 (step S214). The display apparatus 100 outputs the correction data to the offset voltage generation section 143 provided for each data line Ld. The display apparatus 100 multiplies the unit voltage Vunit by the correction data as the offset setting value Minc to generate the offset voltage Vofst ($=Vunit \times Minc$) corresponding to the change amount of the threshold voltage of the transistor Tr13 of each display pixel PIX (pixel drive circuit DC) (step S215; third step).

Then, as shown in FIG. 16, the display apparatus 100 adds, in the voltage adjustment section 144, the negative potential original gradation voltage Vorg output from the gradation voltage generation section 142 and negative potential offset voltage Vofst output from the offset voltage generation section 143 according to the expression (12) to thereby generate the negative potential correction gradation voltage Vpix (step S216) and applies the generated voltage Vpix to the data line Ld (step S217). The correction gradation voltage Vpix generated in the voltage adjustment section 144 is set to have a negative voltage amplitude relative to the writing operation level (low level) power supply voltage Vcc (=Vccw) to be applied from the power supply driver 130 to the power supply voltage line Lv. The correction gradation voltage Vpix becomes lower as the gradation becomes higher.

As a result, the correction gradation voltage Vpix compensated by addition of the offset voltage Vofst corresponding to the change amount of the threshold voltage Vth of the transistor Tr13 is applied to the source terminal (node N12) of the transistor Tr13. Therefore, the compensated voltage Vgs is set to be written in gate-source of the transistor Tr13 (both ends of the capacitor Cs) (fourth step). In such writing operation, a desired voltage is directly applied to the gate terminal and source terminal of the transistor Tr13 without supplying a current corresponding to display data for setting a voltage component, so that it is possible to instantly set the potential of each terminal or node to a desired value.

In the writing operation time period Twrt, the voltage value of the correction gradation voltage Vpix to be applied to the node N12 on the anode terminal side of the organic EL device OLED is set to fall below the reference voltage Vss to be applied to the cathode terminal TMc thereof (that is, organic EL device OLED is set in a reverse bias state). Therefore, a current does not flow in the organic EL device OLED, with the result that the organic EL device OLED does not emit light.

(Holding Operation)

Subsequently, in the holding operation (holding operation time period Thld) performed after the above writing operation time period Twrt, a non-section level (low level) selection signal Ssel is applied to the selection line Ls of i-th row, as shown in FIG. 14. Then, as shown in FIG. 17, the transistors Tr11 and Tr12 are tuned OFF, and diode connection state of the transistor Tr13 is released. At the same time, application of the correction gradation voltage Vpix to the source terminal (node N12) of the transistor Tr13 is stopped, and the voltage component (Vgs=Vpix−Vccw) that has been applied between the gate and source of the transistor Tr13 is charged and held in the capacitor Cs.

At this timing, a selection level (high level) selection signal Ssel is applied to the selection line Ls of (i+1)-th row from the selection driver 120. Then, in the same manner as described above, the correction gradation voltage Vpix corresponding to display data is written in the display pixels PIX of (i+1)-th row. As described above, in the holding operation time period Thld of the display pixels PIX of i-th row, the holding operation continues until the voltage component (correction gradation voltage Vpix) corresponding to display data is sequentially written in the display pixels PIX of the other row.

(Light-emitting Operation)

Next, the light-emitting operation (light-emitting operation time Tem; fifth step) after the writing operation time period Twrt and holding operation time period Thld will be described. As shown in FIG. 14, the display apparatus 100 applies a high potential (light-emitting operation level, positive voltage) power supply voltage (second power supply voltage) Vcc (=Vcce>0V) to the power supply voltage line Lv connected to the display pixels PIX of each row while applying the non-selection level (low level) selection signal Ssel to the selection line Ls of each row.

The high potential power supply voltage Vcc (=Vcce) to be applied to the power supply voltage line Lv is set to be higher than the sum of the saturation voltage (pinch-off voltage Vpo) of the transistor Tr13 and drive voltage (Voled) of the organic EL device OLED, as in the case shown in FIGS. 7 and 8. Therefore, the transistor Tr13 operates in the saturation region. Further, a positive voltage corresponding to the voltage component (|Vpix−Vccw|) that has been set to be written in between the gate and source of the transistor Tr13 by the above writing operation is applied to the anode side (node N12) of the organic EL device OLED, and reference voltage Vss (e.g., ground potential) is applied to the cathode terminal TMc thereof, so that the organic EL device OLED is set in a forward bias state. Thus, as shown in FIG. 18, the light-emission drive current Iem (drain-source current Ids of the transistor Tr13) having a current value corresponding to display data (or more strictly, the corrected gradation voltage Vpix which is a compensated gradation voltage) flows in the organic EL device OLED from the power supply voltage line Lv through the transistor Tr13 and, thereby, the display apparatus 100 emits light at a predetermined luminance gradation.

The above light-emitting operation is continued until the writing operation level (negative voltage) power supply voltage Vcc (=Vccw) is applied from the power supply driver 130 to start the next display drive time period (one process cycle time) Tcyc.

According to a series of such display drive operation, the display apparatus 100 can sequentially perform writing operation of the correction gradation voltage Vpix for the display pixels PIX of each row arranged on the display panel 110 while applying thereto the writing operation level power supply voltage Vcc (=Vccw) and holding the predetermined voltage component (|Vpix−Vccw|), as shown in FIG. 14. Then, the display apparatus 100 applies the light-emitting operation level power supply voltage Vcc (=Vcce) to the display pixels of a row for which the writing operation and holding operation have been completed to allow the display pixels of the relevant row to emit light.

As shown in FIG. 9, in the display apparatus 100 according to the present embodiment, the plurality of display pixels PIX arranged on the display panel 110 are divided into two groups: an upper area and a lower area of the display panel 110, and power supply voltage Vcc is independently applied to the display pixels PIX belonging to the same group through the power supply voltage line Lv branched to each group. Therefore, in the display apparatus 100, the display pixels of a plurality of rows belonging to the same group can emit light simultaneously. Hereinafter, concrete drive control operation performed in this case will be described. In the holding operation and light-emitting operation shown in FIGS. 17 and 18, the connection path switch 149 connects the data line Ld to the voltage adjustment section 144. Alternatively, however, the switching may be made such that the data line Ld is connected neither to the constant current source 148 nor to voltage adjustment section 144, as shown in FIG. 10.

Next, drive control operation performed in the case where the display panel shown in FIG. 9 is employed in the display apparatus according to the present embodiment will concretely be described.

Figure 19:
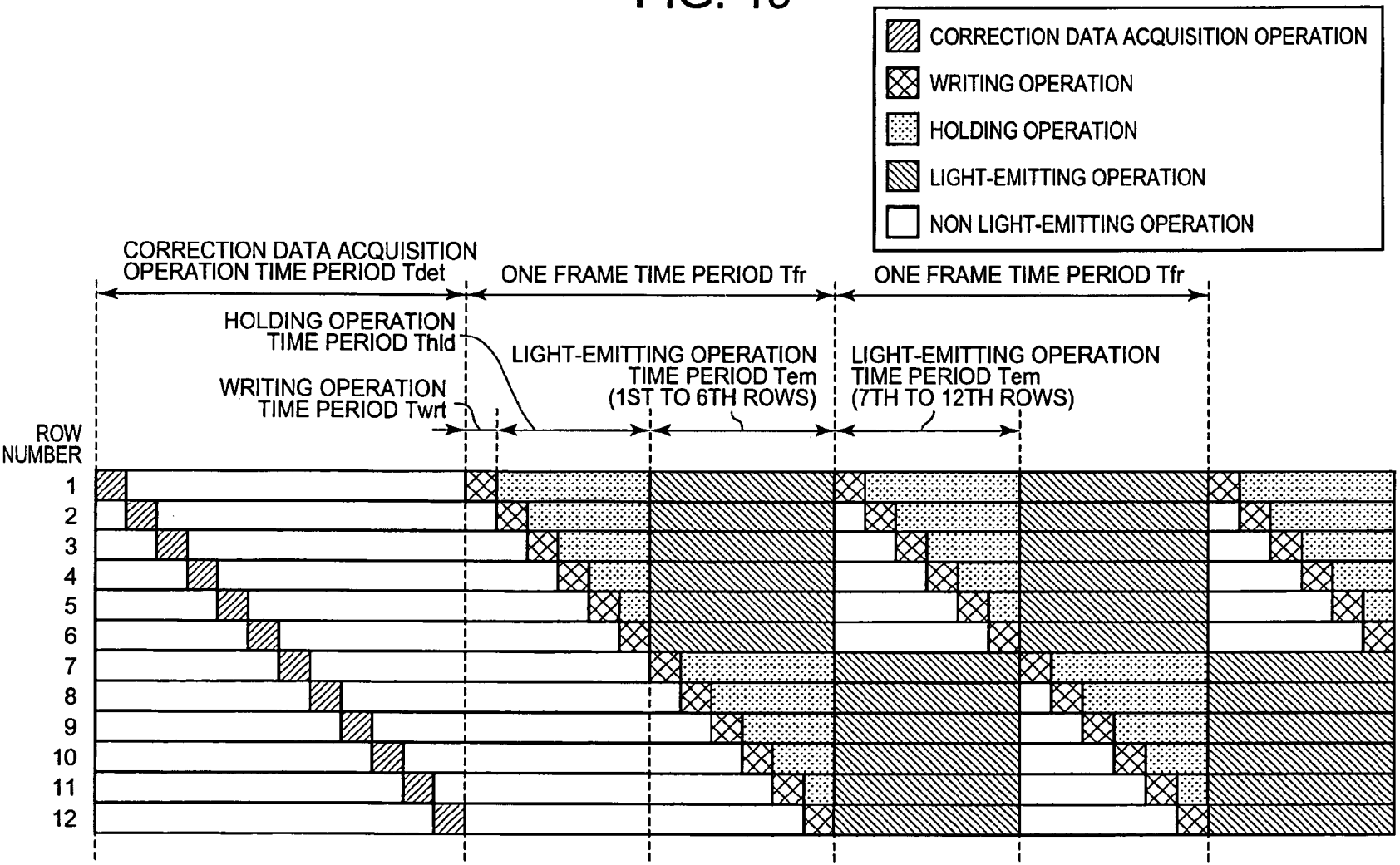
FIG. 19 is an operation timing chart schematically showing a concrete example of a driving method of a display apparatus according to the present embodiment.

FIG. 19 is an operation timing chart schematically showing a concrete example of a driving method of the display apparatus according to the present embodiment. In the example of FIG. 19, display pixels of 12 rows (n=12; 1st to 12th rows) are arranged on the display panel and divided into two with the display pixels of 1st to 6th rows (corresponding to the abovementioned upper area) set in one group and display pixels of 7th to 12th rows (corresponding to the abovementioned lower area) set in the other group.

The display apparatus 100 provided with the display panel 110 shown in FIG. 9 sequentially executes, in the drive control operation, the correction data acquisition operation for all the display pixels PIX arranged on the display panel 110 on a row-by-row basis at a predetermined timing, as shown in FIG. 19. After completing the correction data acquisition operation for all the rows on the display panel 110 (that is, after correction data acquisition operation time period Tadj), the display apparatus 100 writes the correction gradation voltage Vpix within one frame time period Tfr. The correction gradation voltage Vpix to be written in the display pixels PIX (pixel drive circuit DC) of each row arranged on the display panel 110 is a voltage obtained by adding the offset voltage Vofst corresponding to the change amount of the device characteristics of the driving transistor (transistor Tr13) of each display pixel PIX to the original gradation voltage Vorg corresponding to display data. The display apparatus 100 sequentially repeats the operation of holding the predetermined voltage component (|Vpix−Vccw|) for each row. Further, the display apparatus 100 repeatedly executes the display drive operation (display drive time period Tcyc shown in FIG. 14) for allowing the display pixels PIX (organic EL device OLED) that have previously been divided into the upper area group including 1th to 6th rows or lower area group including 7th to 12th rows to simultaneously emit light at a luminance gradation corresponding to display data (correction gradation voltage Vpix) after the completion of the writing operation. As a result, image data corresponding to one screen of the display panel 110 is displayed.

More specifically, a low potential power supply voltage Vcc (=Vccw) is applied to the display pixels PIX of the upper area group including 1th to 6th rows and lower area group including 7th to 12th rows through the power supply voltage line Lv connected in common to each group. In a state where the power supply voltage Vcc (=Vccw) is applied as described above, the correction data acquisition operation (correction data acquisition operation time period Tadj) is executed for all the display pixels PIX arranged on the display panel 110 in an order starting from a smaller row number for each group. Then, with respect to all the display pixels PIX arranged on the display panel 110, the compensation data corresponding to the change amount of the threshold voltage of the transistor Tr13 (driving transistor) provided in the pixel drive circuit DC are individually stored for each display pixel PIX in a predetermined storage area of the frame memory 146.

Subsequently, after the correction data acquisition operation time period Tadj, the display apparatus 100 applies a low potential power supply voltage Vcc (=Vccw) to the display pixels PIX of the upper area group including 1st to 6th rows through the power supply voltage line Lv connected in common to the display pixels PIX of the upper area group. In this state, the display apparatus 100 executes the writing operation (writing operation time period Twrt) and holding operation (holding operation time period Thld) for the display pixels PIX of the upper area group in an order starting from the display pixels of 1st row. At the timing when completing the writing operation for the display pixels PIX of 6th row, the display apparatus 100 changes its power supply voltage so as to apply a high potential power supply voltage Vcc (=Vcce) through the power supply voltage line Lv connected in common to the display pixels of the upper area group. As a result of the changeover for the power supply voltage Vcc, the display apparatus 100 allows simultaneous light emission of the display pixels PIX correspond to (the 1st to the 6th rows) within the upper area group at a luminance gradation based on the display data (correction gradation voltage Vpix) being written for each display pixel PIX. This light emitting operation continues (light-emitting operation time period Tem of 1th to 6th rows) until the timing at which the next writing operation is started for the display pixels PIX of the 1st row.

At the timing when completing the writing operation for the display pixels PIX of 1st to 6th rows, the display apparatus 100 applies a low potential power supply voltage Vcc (=Vccw) to the display pixels PIX of the lower area group including 7th to 12th rows through the power supply voltage line Lv connected in common to the display pixels PIX of the lower area group. In this state, the display apparatus 100 executes the writing operation (writing operation time period Twrt) and holding operation (holding operation time period Thld) for the display pixels PIX of the lower area group in an order starting from the display pixels PIX of 7th row. At the timing when the writing operation for the display pixels PIX correspond to the 12th row is completed, the display apparatus 100 changes its power supply voltage so as to apply a high potential power supply voltage Vcc (=Vcce) through the power supply voltage line Lv connected in common to the display pixels PIX of the lower area group. As a result of the changeover for the power supply voltage Vcc, the display apparatus 100 allows simultaneous light emission of the display pixels PIX correspond to (the 7th to the 12th rows) within the lower area group at a luminance gradation corresponding to the display data (correction gradation voltage Vpix) that has been written for each display pixel PIX (light-emitting operation time period Tem of 7th to 12th rows). As described above, during the time period during which the writing operation and holding operation are performed for the display pixels of 7th to 12th rows, the high potential power supply voltage Vcc (=Vcce) continues to be applied to the display pixels PIX of 1st to 6th rows through the power supply voltage line Lv so as to allow them to simultaneously emit light.

As described above, the display apparatus 100 sequentially executes the writing operation and holding operation for the display pixels PIX of each row at a predetermined timing after performing the correction data acquisition operation for all the display pixels arranged on the display panel 110. Then, the display apparatus 100 controls the drive at the timing when the writing operation to display pixels PIX related to all the rows included in each of the previously set group in order to allow a simultaneous emission of all the display pixels PIX included in the group concerned.

Consequently, according to the driving method (display drive operation) of the display apparatus, during the time period within the one frame period Tfr, in which the writing operation is performed for the display pixels of each row included in one group, the light-emitting operation of all the display pixels (light-emitting devices) in the group is not performed, that is, all the display pixels can be set in a non-light emitting state (black display state). In the operation timing chart shown in FIG. 19, the display pixels of 12 rows constituting the display panel 110 are divided into two groups, and display pixels of the respective groups are controlled to simultaneously perform light-emitting operation at different timings. Consequently, the ratio of the black display time period (the black insertion ratio) with the non-light emitting operation in one frame period Tfr can be set at 50%. Here, in human sense of vision, generally, the presence of approximately 30% or more of the black insertion ratio constitutes an indication for a visual recognition of moving images which is clear and free from flickering thereof. Consequently, according to the present driving method, there can be realized a display apparatus having a favorable image quality.

In the present embodiment (FIG. 9), the plurality of display pixels PIX arranged on the display panel 110 is divided into two groups by setting 6 rows of display pixels PIX to one group like mutually adjacent rows such as 1st to 6th rows and 7th to 12th rows. Alternatively, however, the display pixels may be divided into an arbitrary number of groups such as three or four. Further, the display pixels may be divided into a group of the odd number rows and a group of the even number rows. Thus, it is possible to arbitrarily set the light-emitting time period and black display time period (black display state) depending on the number of groups, improving the display quality.

A configuration in which the display pixel PIX are not divided into groups in the manner as described above may be adopted. In this case, the power supply voltage line Lv may be provided for each row (connected to each row), and the power supply voltage Vcc is applied to the display pixels PIX of each row at an individual timing to thereby allow the display pixels of each row to perform light-emitting operation. Further, the power supply voltage Vcc may simultaneously be applied in common to all the display pixels PIX corresponding to one screen of the display panel 110 so as to allow all the display pixels PIX corresponding to one screen of the display panel 110 to perform light-emitting operation.

As described above, the display apparatus and its driving method according to the present embodiment directly apply the correction gradation voltage Vpix specifying a voltage value corresponding to the display data and the change amount of the device characteristics (threshold voltage) of the driving transistor (transistor Tr13) between the gate and source of the driving transistor in the writing operation time period of the display data. This allows a voltage-specifying type (or voltage application type) gradation control method in which a predetermined voltage component is held by a capacitor (capacitor Cs) and the light-emission drive current Iem to be supplied to a light-emitting device (organic EL device OLED) is controlled on the basis of the voltage component so as to allow the light-emitting device to emit light at a desired luminance gradation to be applied to the display apparatus.

Therefore, even in the case where a display panel having an increased size or having higher definition or where low gradation display is performed, it is possible to quickly and reliably write a gradation signal (correction gradation voltage) corresponding to display data for each display pixel as compared to a current-specifying gradation control method in which a current corresponding to display data is supplied so as to perform the writing operation (hold a voltage component corresponding to display data). Thus, the display apparatus 100 can perform light-emitting operation at an appropriate luminance gradation corresponding to display data while suppressing occurrence of insufficient writing, thereby realizing favorable display image quality.

Further, before the display drive operation including the writing operation of display data for the display pixel (pixel drive circuit), holding operation, and light-emitting operation, the display apparatus 100 acquires correction data corresponding to the change amount of the threshold voltage of the driving transistor provided in each display pixel. Then, in the writing operation, the display apparatus 100 can generate a gradation signal (correction gradation voltage) corresponding to each display pixel on the basis of the correction data and applies to each display pixel. Thus, it is possible to compensate the influence (shift of the voltage-current characteristics of the driving transistor) of the change in the threshold value and, thereby, to allow each display pixel (light-emitting device) to emit light at appropriate luminance gradation corresponding to display data. As a result, a variation in the light-emission characteristics between the display pixels can be suppressed, thus improving the display image quality.

Various embodiments and changes may be made thereunto without departing from the broad spirit and scope of the invention. The above-described embodiment is intended to illustrate the present invention, not to limit the scope of the present invention. The scope of the present invention is shown by the attached claims rather than the embodiment. Various modifications made within the meaning of an equivalent of the claims of the invention and within the claims are to be regarded to be in the scope of the present invention.

This application is based on Japanese Patent Application No. 2006-218760 filed on Aug. 10, 2006 and including specification, claims, drawings and summary. The disclosure of the above Japanese Patent Application is incorporated herein by reference in its entirety.

What is claimed is:

1. A display apparatus comprising:

a light-emitting device;

a pixel drive circuit which is connected to the light-emitting device;

a display driver including a voltage adjustment section which adjusts a potential of an adjustment voltage such that the potential of the adjustment voltage is approximated to a potential which is changed in accordance with a change amount of characteristics inherent to the pixel drive circuit when a reference current having a predetermined current value is supplied to the pixel drive circuit; and a data line which connects the display driver and the pixel drive circuit;

wherein the display driver includes a voltage comparison section which supplies the reference current to the pixel drive circuit and compares the potential adjusted by the voltage adjustment section and the potential which is changed in accordance with the change amount of the characteristics inherent to the pixel drive circuit when the reference current is supplied to the pixel drive circuit; and wherein the display driver includes an offset voltage generation section which generates an offset voltage based on a result of the comparison made by the voltage comparison section.

2. The display apparatus according to claim 1, wherein the voltage adjustment section generates the adjustment voltage based on a gradation voltage having a predetermined potential corresponding to a display data and the offset voltage set according to the potential which is changed in accordance with the change amount of the characteristics inherent to the pixel drive circuit.

3. The display apparatus according to claim 1, wherein the voltage comparison section includes a current source which supplies the reference current.

4. The display apparatus according to claim 3, wherein the voltage comparison section includes a connection path switch which switchingly connects one of the current source and the voltage adjustment section to the data line.

5. The display apparatus according to claim 4, wherein the potential which is changed in accordance with the change amount of the characteristics inherent to the pixel drive circuit while the reference current is being supplied to the pixel drive circuit, is output to the voltage comparison section when the connection path switch connects the current source to the data line.

6. The display apparatus according to claim 1, wherein when the voltage comparison section determines that the potential adjusted by the voltage adjustment section is higher than the potential which is changed in accordance with the change amount of the characteristics inherent to the pixel drive circuit while the reference current is being supplied to the pixel drive circuit, the offset voltage generation section modulates the offset voltage.

7. The display apparatus according to claim 1, wherein the offset voltage generation section counts a number of inputs of a signal output from the voltage comparison section when the potential adjusted by the voltage adjustment section is higher than the potential which is changed in accordance with the change amount of the characteristics inherent to the pixel drive circuit while the reference current is being supplied to the pixel drive circuit.

8. The display apparatus according to claim 7, wherein the offset voltage generation section modulates the offset voltage according to an offset setting value which is changed depending on the number of inputs of the signal output from the voltage comparison section.

9. The display apparatus according to claim 8, wherein the offset voltage has a value obtained by multiplying the offset setting value by a unit voltage.

10. The display apparatus according to claim 8, wherein the display driver includes a storage section which stores the offset setting value output from the offset voltage generation section, and wherein the offset voltage generation section outputs an offset voltage obtained by multiplying the offset setting value output from the storage section by a unit voltage to the voltage adjustment section.

11. The display apparatus according to claim 1, wherein the offset voltage generation section outputs the offset setting value which is changed depending on the number of inputs of the signal output from the voltage comparison section according to the signal which is output from the voltage comparison section when the potential adjusted by the voltage adjustment section is not greater than the potential which is changed in accordance with the change amount of the characteristics inherent to the pixel drive circuit while the reference current is being supplied to the pixel drive circuit.

12. The display apparatus according to claim 11, wherein the display driver includes a storage section which stores the offset setting value output from the offset voltage generation section.

13. The display apparatus according to claim 12 further comprising a plurality of display pixels each constituted by a set of the light-emitting device and the pixel drive circuit, wherein the storage section stores the offset setting value in units of each display pixel.

14. The display apparatus according to claim 1, wherein the pixel drive circuit includes a driving transistor connected in series to the light-emitting device.

15. The display apparatus according to claim 14, wherein the pixel drive circuit includes a selection transistor connected between the driving transistor and the data line, and a transistor for diode connection which sets the driving transistor in a diode connection state.

16. A method for driving a display apparatus which includes a light-emitting device, a pixel circuit which is connected to the light-emitting device, a display driver, and a data line which connects the display driver and pixel circuit, the method comprising:

supplying a reference current having a predetermined current value to the pixel drive circuit;

adjusting a potential of an adjustment voltage for activating the display driver such that the potential of the adjustment voltage is approximated to a potential which is changed in accordance with a change amount of characteristics inherent to the pixel drive circuit when the reference current is supplied to the pixel drive circuit;

comparing the adjusted potential and the potential which is changed in accordance with the change amount of the characteristics inherent to the pixel drive circuit when the reference current is supplied to the pixel drive circuit; and generating an offset voltage based on a result of the comparison.

* * * * *